US007384108B2

(12) United States Patent
Lam et al.

(10) Patent No.: US 7,384,108 B2
(45) Date of Patent: Jun. 10, 2008

(54) DRAWER GUIDE RAIL ASSEMBLY

(75) Inventors: Harn Lian Lam, Perak (MY); Harn Yan Lam, Perak (MY)

(73) Assignee: Harn Marketing SDN BHD, Ipoh, Perak (MY)

( * ) Notice: Subject to any disclaimer, the term of this patent is extended or adjusted under 35 U.S.C. 154(b) by 185 days.

(21) Appl. No.: 11/350,199

(22) Filed: Feb. 8, 2006

(65) Prior Publication Data

US 2006/0186772 A1 Aug. 24, 2006

(30) Foreign Application Priority Data

Feb. 21, 2005 (MY) ..... PI 20050660
Dec. 1, 2005 (MY) ..... PI 20055626

(51) Int. Cl.
*A47B 88/04* (2006.01)

(52) U.S. Cl. ..... 312/334.44; 312/333; 312/334.8; 384/21

(58) Field of Classification Search ..... 312/333, 312/334.44, 330.1, 334.32–334.34, 319.1, 312/334.12, 334.13; 384/20, 21; 16/84
See application file for complete search history.

(56) References Cited

U.S. PATENT DOCUMENTS

| | | | | |
|---|---|---|---|---|
| 6,736,471 | B2 * | 5/2004 | Lin | 312/333 |
| 6,846,053 | B2 * | 1/2005 | Salice | 312/334.14 |
| 2001/0008358 | A1 | 7/2001 | Brustle | |
| 2002/0096405 | A1 | 7/2002 | Gasser | |
| 2003/0067257 | A1 | 4/2003 | Gasser | |
| 2004/0000851 | A1 * | 1/2004 | Lam Harn et al. | 312/334.7 |
| 2004/0104650 | A1 * | 6/2004 | Egger | 312/333 |

(Continued)

FOREIGN PATENT DOCUMENTS

| | | |
|---|---|---|
| CN | 1619181 | 5/2005 |

(Continued)

*Primary Examiner*—Janet Wilkens
*Assistant Examiner*—Mart K Kuhn
(74) *Attorney, Agent, or Firm*—Volpe and Koenig, P.C.

(57) ABSTRACT

A guide rail assembly for slidably opening and closing a drawer within an enclosure is disclosed. The assembly comprises a mounting bracket (10) for fixing the assembly to the enclosure, a fixed rail (20) on the mounting bracket for receiving an intermediate rail (30), an intermediate rail capable of sliding back and forth relative to the fixed rail, an outer pull out guide (40) for attachment to the drawer and being capable of sliding back and forth on the intermediate rail relative to the intermediate rail and the fixed rail, a protrusion (43) on the bottom surface of the outer pull out guide, a damping device (80) and a channel guide (60) disposed along the mounting bracket adjacent the fixed rail. The damping device is resiliently compressible in a length-wise direction and the channel guide is provided with a sliding member (70). The sliding member includes an inner portion (71) that travels within the guide and an outer portion (72) that extends outwardly from the guide so as to be contactable by the pull out guide protrusion. The inner portion of the sliding member locates an end (82) of the damping device that can be pushed inwardly to provide damping. During a closing action of the assembly, the outer pull out guide is caused to slide in a drawer-closing direction and when the protrusion reaches and contacts the sliding member outer portion, the sliding member travels within the channel guide against the resilience of the damping device and causes deceleration of the drawer-closing motion.

18 Claims, 19 Drawing Sheets

U.S. PATENT DOCUMENTS

| | | | | |
|---|---|---|---|---|
| 2005/0098394 | A1* | 5/2005 | Baldreich | 188/67 |
| 2005/0116593 | A1* | 6/2005 | Berger | 312/333 |

FOREIGN PATENT DOCUMENTS

| | | | |
|---|---|---|---|
| DE | 24 21 657 | | 11/1975 |
| DE | 202 17 975 | U1 | 1/2003 |
| DE | 202 18 067 | U1 | 1/2003 |
| DE | 20 2004 019 738 | U1 | 3/2005 |
| DE | 203 18 929 | U1 | 4/2005 |
| DE | 203 19 598 | U1 | 5/2005 |
| EP | 1 106 768 | A2 | 6/2001 |
| EP | 1 188 397 | A1 | 3/2002 |
| EP | 1 336 357 | A | 8/2003 |
| EP | 1 479 317 | A | 11/2004 |
| WO | WO 01/50917 | A1 | 7/2001 |
| WO | WO 2004/045339 | A | 6/2004 |
| WO | WO 2005/011438 | A1 | 2/2005 |
| WO | WO 2005/044046 | A1 | 5/2005 |

* cited by examiner

DRAWER GUIDE RAIL ASSEMBLY

This invention relates to a guide rail assembly for use in the furniture industry, and more particularly in a drawer that is slidably opened and closed.

Drawer guide rails are components in common every day use, such as for drawers in desks or cabinets, and for industrial use such as pull out storage shelves at a warehouse, cash registers at a supermarket, automated teller machines at banking kiosks, electronic equipment at telephone switching stations and so on.

DESCRIPTION OF THE PRIOR ART

Guide rail systems are provided for drawers to be either partially or fully opened or closed and typically consist of a bracket for fixing the system to the article of furniture, a fixed rail mounted on the bracket, a pull-out rail attached to the side of the drawer, and preferably an intermediate rail in between the fixed and pull-out rails. The intermediate rail is slidable over the fixed rail and the pull-out rail is slidable over the intermediate rail normally due to slidable roller housings disposed within the fixed and pull-out rails. Each of the fixed, intermediate and pull-out rails is also normally disposed with pairs of limit stoppers. The distance traveled by the slidable roller housings between each pair of limit stoppers on each rail element typically defines the travel distance of each rail.

When a drawer having this typical guide rail system is pushed in or closed with excessive force, loud noise would inevitably be produced as a result of contact and movement between the rail elements as well as sliding housings. Also and more importantly, excessive force results in accelerated and uncontrolled closing motion of this typical guide rail assembly which would damage the rail elements of the assembly and the article of furniture.

It would therefore be desirable to have a guide rail assembly that solves the above-stated problems. Such a drawer guide rail system having a damping device is disclosed in US publication no. 2005/0098394 A1. In this prior system, a stationary cabinet mounting rail and a drawer pull out rail slidable on the cabinet mounting rail via rollers either mounted on the rails or in carriages having rollers which run between the rails are disclosed. A linear damper is removably mounted within a trough-shaped mounting plate that is in turn removably mounted in a recess on the horizontal ridge of the cabinet mounting rail. The linear damper is constructed as a fluid damper having a cylinder with a piston rod. Also, the drawer pull out rail of this system is provided with a laterally projecting tab having a plastic cap. Both of these laterally projecting tab and cap, forms a stop which is engagable with the linear damper.

The push-in motion of the drawer is decelerated by the action of the laterally projecting stop on the pull out rail impacting the linear damper on the horizontal ridge of the mounting rail. The impact of the pull out rail stop on the cylinder of the linear damper causes it to be pushed backwards. Consequently, there is relative movement between a portion of the piston rod disposed within the cylinder and the cylinder. The linear damper is oriented within the mounting plate such that the piston rod is located at the rear mounting plate and the cylinder is located at the front with both rear and front being relative to drawer orientation. The rear longitudinal end of the mounting plate is provided with an aperture in which the distal end of the linear damper rod is held in place.

As is obvious from the description of the manner and structure of this prior guide rail system, deceleration of the drawer closing motion is achieved by direct contact between the drawer pull out rail stop and a front longitudinal end of the linear damper cylinder. Also, in this prior system, when the drawer is fully closed, the linear damper is in a fully compressed state with the piston rod completely pushed into the cylinder and the rear longitudinal end of the cylinder abutting against the longitudinal end of the mounting plate on which the piston rod is anchored. This would likely cause unnecessary damage to the linear damper of this prior system in the event of frequent usage or excessive drawer-closing force and will lead to the need for frequent replacement of the linear damper.

Also, the backwards lengthwise movement of the cylinder pushing the piston rod into the cylinder and therefore compressing the linear damper, is not supported or guided. This will likely result in the movement of the rod into the cylinder, being not consistently along the same axis leading to less than sufficient compression of the linear damper and therefore, ineffective damping or deceleration of the drawer-closing force.

Additionally, the fact that the mounting plate of the linear damper is mounted within a recess on the horizontal ridge of the cabinet mounting rail limits the usage of this prior system as it does not allow for adjustment due to the variation in length of the rail elements. In other words, this prior system lacks versatility as it does not allow for flexibility in the positioning of the linear damper-mounting plate on the cabinet mounting rail.

This invention thus aims to alleviate some or all of the problems of the prior art, and to provide a guide rail assembly having a damping device that effectively decelerates the drawer closing motion while providing for substantially quiet and controlled drawer closing as well as allows for vigorous and sustained usage.

SUMMARY OF THE INVENTION

In one aspect of the invention, a guide rail assembly for slidably opening and closing a drawer within an enclosure is provided. The assembly comprises a mounting bracket for fixing the assembly to the enclosure, the mounting bracket having a fixed rail for receiving an intermediate rail, an intermediate rail capable of sliding back and forth relative to the fixed rail, an outer pull out guide for attachment to the drawer and being capable of sliding back and forth on the intermediate rail relative to the intermediate rail and the fixed rail, a protrusion on the bottom surface of the outer pull out guide, a damping device and a channel guide disposed along the mounting bracket adjacent the fixed rail. The damping device is resiliently compressible in a lengthwise direction and the channel guide is provided with a sliding member. The sliding member includes an inner portion that travels within the guide and an outer portion that extends outwardly from the guide so as to be contactable by the pull out guide protrusion. The inner portion of the sliding member locates an end of the damping device that can be pushed inwardly to provide damping. During a closing action of the assembly, the outer pull out guide is caused to slide in a drawer-closing direction and when the protrusion reaches and contacts the sliding member outer portion, the sliding member travels within the channel guide against the resilience of the damping device and causes deceleration of the drawer-closing motion.

In an embodiment, the damping device comprises a cylinder body and a rod that is pushable into the cylinder body when the device is compressed, the distal end of the rod being located in the sliding member inner portion. It is preferred that the damping device is a fluid damper.

In another embodiment, the channel guide is a U-shaped channel having an open side and open longitudinal ends such that the sliding member outer portion extends outwardly through the open side of the channel guide and the sliding member inner portion receives an end of the damping device through an open longitudinal end. The sliding member inner portion preferably further comprises an aperture for receiving the end of the damping device.

In yet another embodiment, the fixed rail further comprises a stopper located at a position on the fixed rail upper surface such that the stopper is forward relative to the rear travel limit position of the sliding member within the channel guide. The stopper is preferably an L-shaped bracket.

According to a further embodiment, the outer pull out guide protrusion further comprises a protruding surface and an abutment surface, the protruding and abutment surfaces engagable with the outer portion of the sliding member and the fixed rail stopper respectively.

In accordance with another aspect of the invention, a guide rail assembly for slidably opening and closing a drawer within an enclosure is provided. The assembly comprises a mounting bracket for fixing the assembly to the enclosure, the mounting bracket having a fixed rail for receiving an intermediate rail, an intermediate rail capable of sliding back and forth relative to the mounting bracket fixed rail, an outer pull out guide for attachment to the drawer and being capable of sliding back and forth on the intermediate rail relative to the intermediate rail and the fixed rail, and having a protrusion on the bottom surface of the outer pull out guide, a damping device and a channel guide disposed along the mounting bracket adjacent its fixed rail. The damping device is resiliently compressible in a lengthwise direction and the channel guide is provided with a sliding member. The sliding member includes an inner portion that travels along the guide and an outer portion that extends upwardly from the guide so as to be contactable by the pull out guide protrusion and locates an end of the damping device that can be pushed inwardly to provide damping. During a closing action of the assembly, the outer pull out guide is caused to slide in a drawer-closing direction and when the protrusion reaches and contacts the sliding member outer portion, the sliding member travels within the channel guide against the resilience of the damping device and causes deceleration of the drawer-closing motion.

In an embodiment of this aspect, the damping device comprises a cylinder body and a rod that is pushable into the cylinder body when the device is compressed, the distal end of the rod being located in the sliding member outer portion. Preferably, the damping device is a fluid damper.

In another embodiment, the channel guide has an open top and an open longitudinal end such that the sliding member outer portion extends upwardly through the open top of the channel guide and the sliding member outer portion locates the end of the damping device through an open longitudinal end of the channel. The sliding member outer portion preferably has an aperture for receiving the end of the damping device.

In a further embodiment, the mounting bracket further comprises a stopper disposed adjacent the channel guide such that the stopper is forward relative to the rear travel limit position of the sliding member within the channel guide. The stopper is preferably a tab that is integral with the mounting bracket.

According to another embodiment, the outer pull out guide protrusion further comprises a protruding surface and an abutment surface, the protruding and abutment surfaces engagable with the outer portion of the sliding member and the mounting bracket stopper respectively.

In yet another embodiment of this aspect, the intermediate rail comprises a C-shaped guide that is slidable along the mounting bracket fixed rail and a channel piece disposed on top of said C-shaped guide, whereby the outer pull out guide is slidable along the channel piece of the intermediate rail.

In an embodiment of both aspects of the invention, the outer pull out guide protrusion is disposed toward a front end of the pull out guide. Also, the outer pull out guide protrusion may be removable from the pull out guide.

According to another embodiment of both aspects of the invention, the fixed rail and outer pull out guide each further comprises a slidable housing having a plurality of rollers that enables the intermediate rail to be slidable on the fixed rail and the outer pull out guide to be in turn slidable on the intermediate rail.

The objective of the guide rail assembly having a damping device of this invention is to provide a substantially quiet, controlled drawer-closing motion that is most importantly, effectively decelerated. As is apparent from the preceding paragraphs, due to the configuration of the guide rail assembly of this invention and particularly the structure and location of the damping device and channel guide with sliding member, deceleration of the drawer-closing motion is achieved without direct contact between the outer pull out guide protrusion and the damping device. Also, this would allow for the drawer-closing force to be partially absorbed by the sliding member as it slides within the channel guide with the remainder of the drawer-closing force absorbed due to compression of the damping device. This would not only result in effective deceleration of the drawer closing motion but also protects the damping device, both its cylinder body and rod, from being damaged, therefore enabling it to be longer lasting.

Additionally, the configuration of the channel guide with sliding member locating a distal end of the damping device rod within ensures that the linear movement of the damping device rod as it is being pushed into the damping device cylinder body is consistently along the same axis. This is possible due to the sliding member being slidably mounted within the channel guide, therefore allowing the sliding movement of the sliding member to be completely guided by the channel guide. Obviously, this leads to more effective compression of the damping device and as such, more effective force absorbing and drawer closing motion deceleration.

Furthermore, due to the position of the stopper (on the fixed rail in the first aspect and on the horizontal flange of the mounting bracket in the other aspect) adjacent the channel guide such that the stopper is relative to the rear travel limit position of the sliding member within the channel guide, when drawer is in a fully closed position, the outer pull out guide protrusion rests against the stopper thus, preventing the sliding member from being slammed against the damping device. Again, this would lessen the possibility of damage to the damping device.

The versatility of this guide rail assembly is also greatly increased as variations in length of rail elements can be easily accommodated by simply re-locating the stopper (on the fixed rail in the first aspect and on the horizontal flange of the mounting bracket in the other aspect) such that it is always positioned adjacent the damping device and channel guide with sliding member so as to be forward relative to the rear travel limit position of the sliding member within the channel guide. This advantageous feature therefore, allows the assembly to be used with rail elements of varying lengths without the need for substantial re-designing or re-sizing of any of the essential components, namely, the damping device, channel guide with sliding member, stopper or outer pull out guide protrusion.

BRIEF DESCRIPTION OF THE DRAWINGS

The invention is illustrated, although not limited, by the following description of embodiments made with reference to the accompanying drawings in which.

DETAILED DESCRIPTION OF THE EMBODIMENTS

Figure 1:
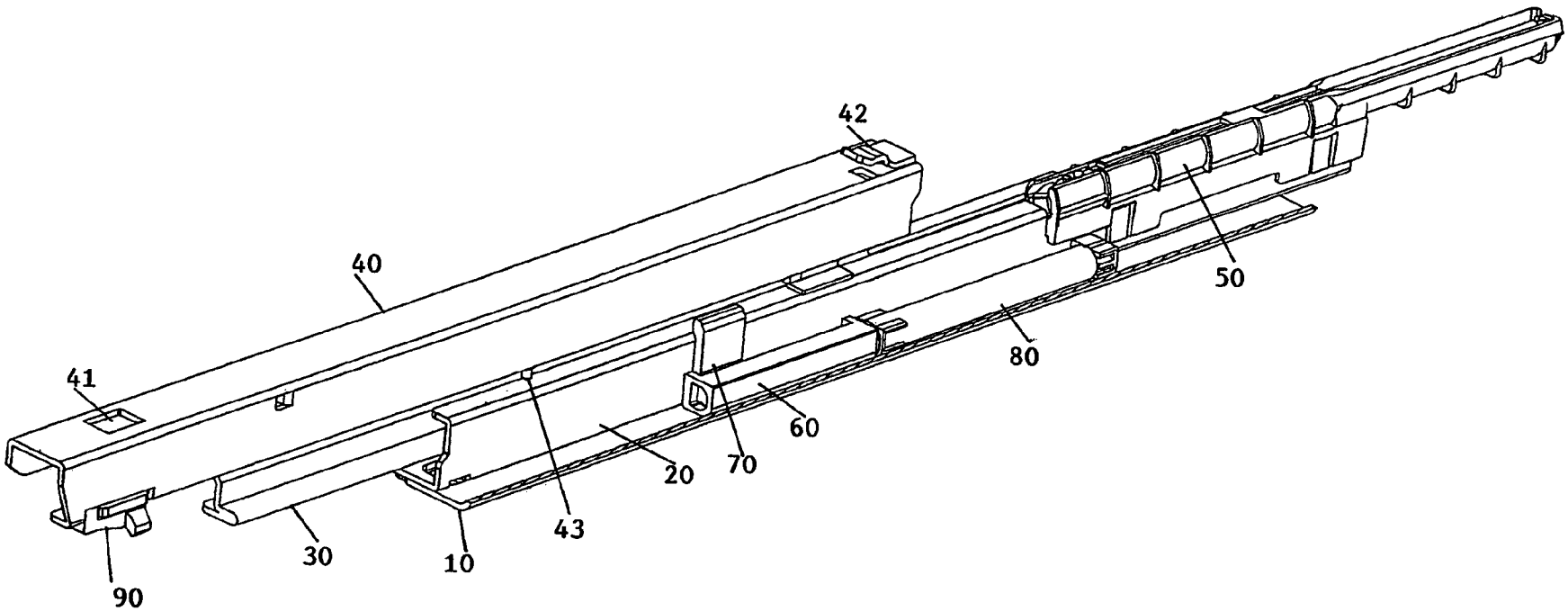
FIG. 1 shows a perspective view of the guide rail system according to a first embodiment of the invention with the vertical flange of the mounting bracket not shown.
Figure 2:
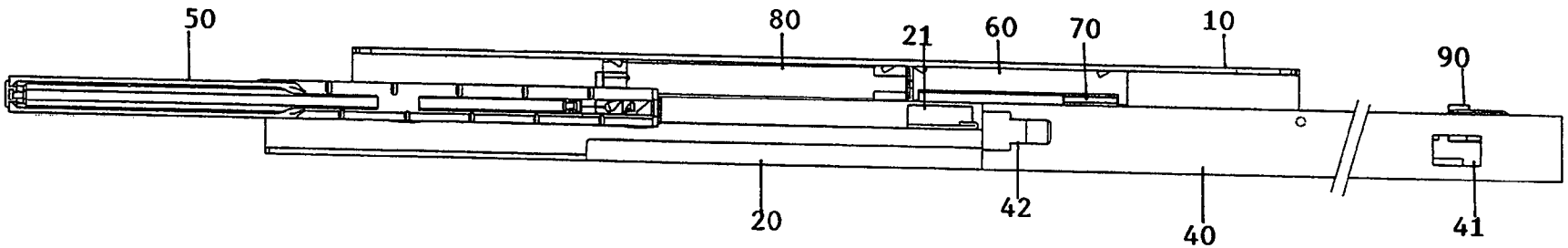
FIG. 2 shows a top view of FIG. 1.
Figure 3:
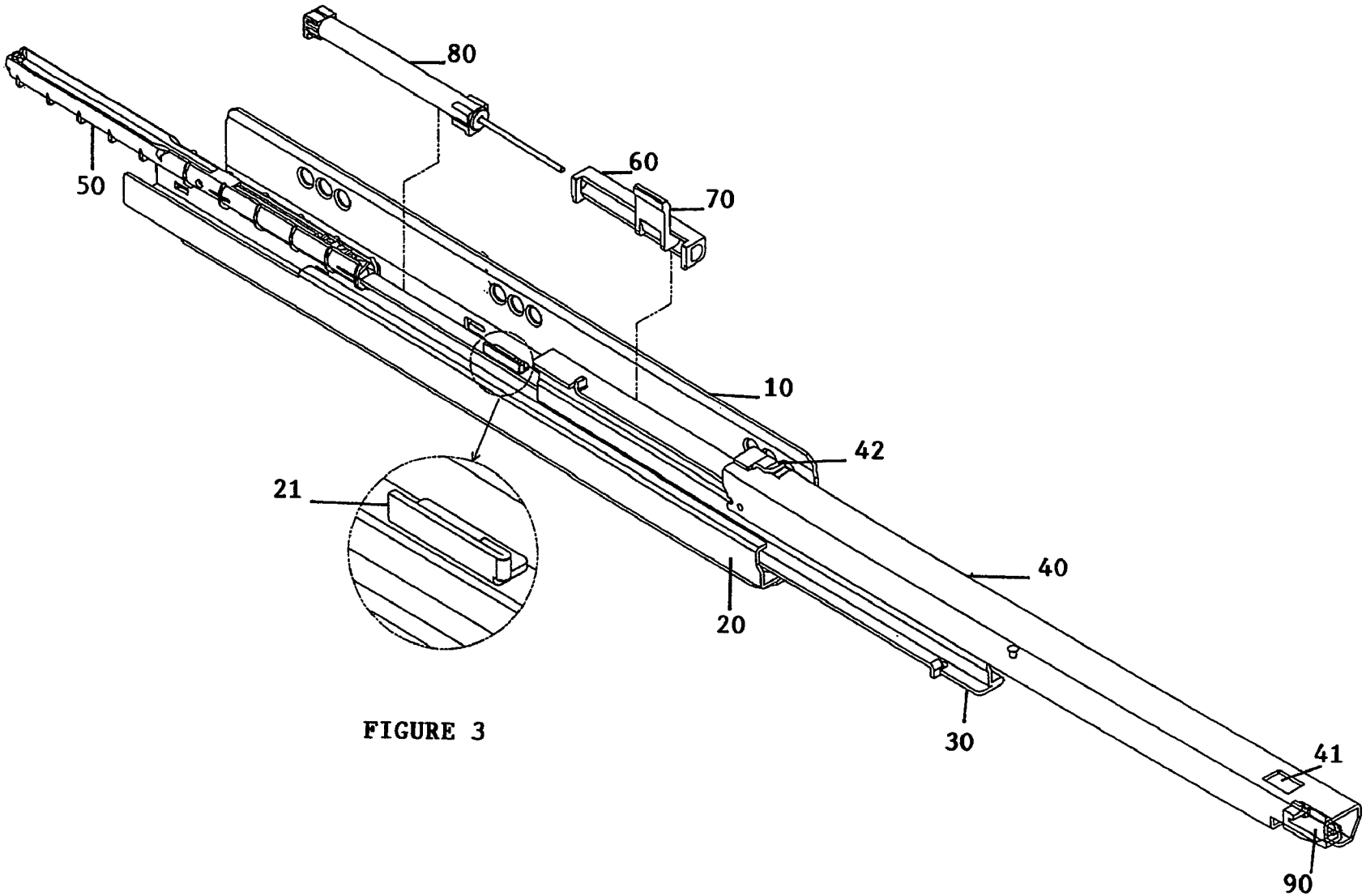
FIG. 3 is an exploded left perspective view of FIG. 1.

FIGS. 1 to 9 shows a first embodiment of a guide rail assembly of the present invention having a damping device 80 assembled therein. This guide rail assembly comprises of a mounting bracket 10 for fixing the assembly to an enclosure, a fixed rail 20 mounted on the mounting bracket 10, an intermediate rail 30 and an outer pull out guide 40 secured to the drawer side. The fixed rail 20 and outer pull out guide 40 each have a slidable housing (not shown) having a plurality of rollers, which enables the intermediate rail 30 to be slidable on the fixed rail 20 and the outer pull out guide 40 to be in turn slidable on the intermediate rail 30, as shown in FIGS. 1 and 3. In this first embodiment, a damping device 80 and a channel guide 60 with sliding member 70 are mounted on and along the mounting bracket 10 adjacent the fixed rail 20.

Figure 6A:
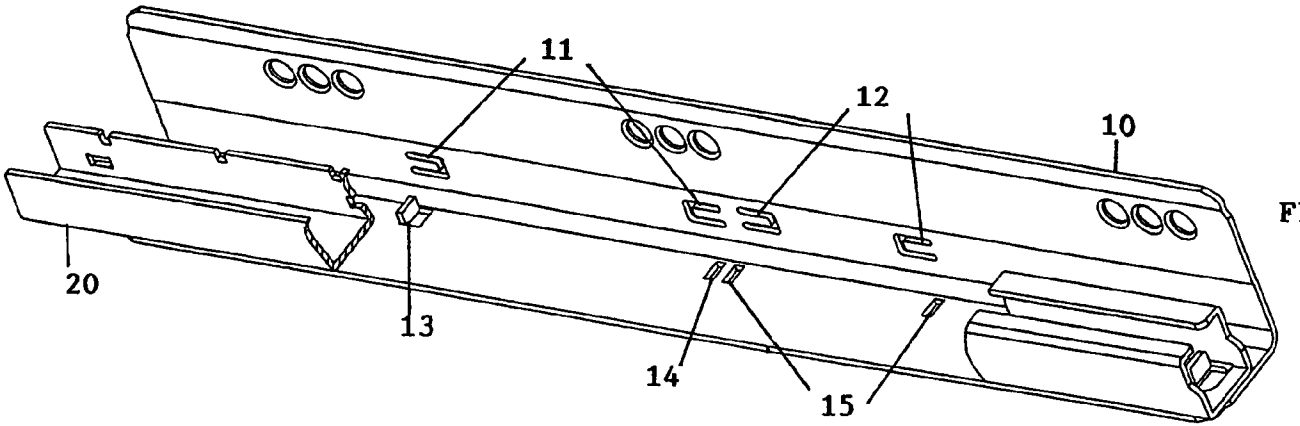
FIGS. 6A and 6B shows the manner of mounting a damping device and channel guide with sliding member onto a mounting bracket of FIG. 1.
Figure 6B:
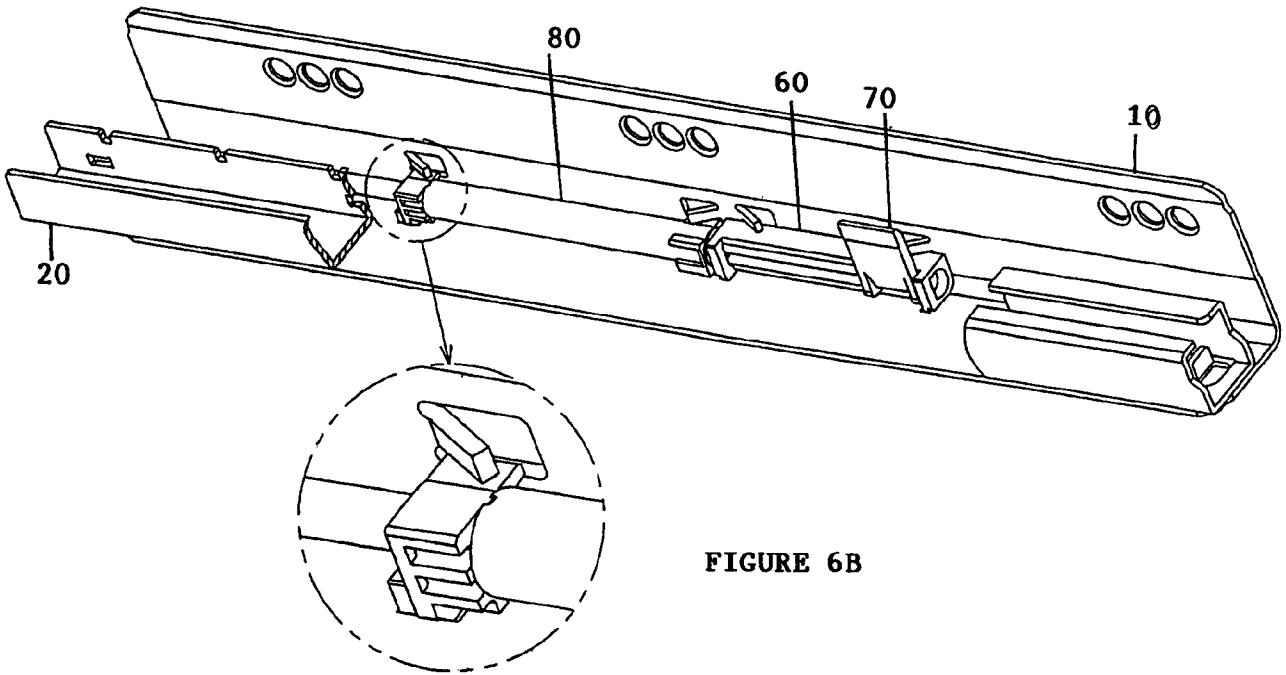

FIGS. 3, 6A and 6B shows a mounting bracket 10 formed from sheet metal into a substantially L-section comprising of a vertical flange and a horizontal flange. The vertical flange has a multitude of holes for fixing to the side of an article of furniture such as a cabinet or chassis into which a drawer or equipment is to be installed. Stepped edges are also formed on this vertical flange in order to increase its rigidity. Similarly, notches are formed at the bent edge of the L-section for increasing the rigidity and load capacity of this support means. The fixed rail 20 of the assembly is attached onto the horizontal flange of the mounting bracket. Additionally, the damping device 80 and channel guide 60 with sliding member 70 are longitudinally mounted on the horizontal flange adjacent the fixed rail 20. Both the damping device 80 and channel guide 60 with sliding member 70 are located longitudinal end to longitudinal end relative to each other with the damping device 80 in a rear position and the channel guide 60 in a front position, both rear and front positions being relative to drawer orientation within the article. Two pairs of punched out metal tabs 11, 12 are provided on the vertical flange as means for firmly holding the damping device 80 and channel guide 60. A punched out metal tab with aperture 13 and slots 14, 15 is also provided on the horizontal flange of the mounting bracket 10 to aid in firmly holding the damping device 80 and channel guide 60.

Figures 4A, 4B:
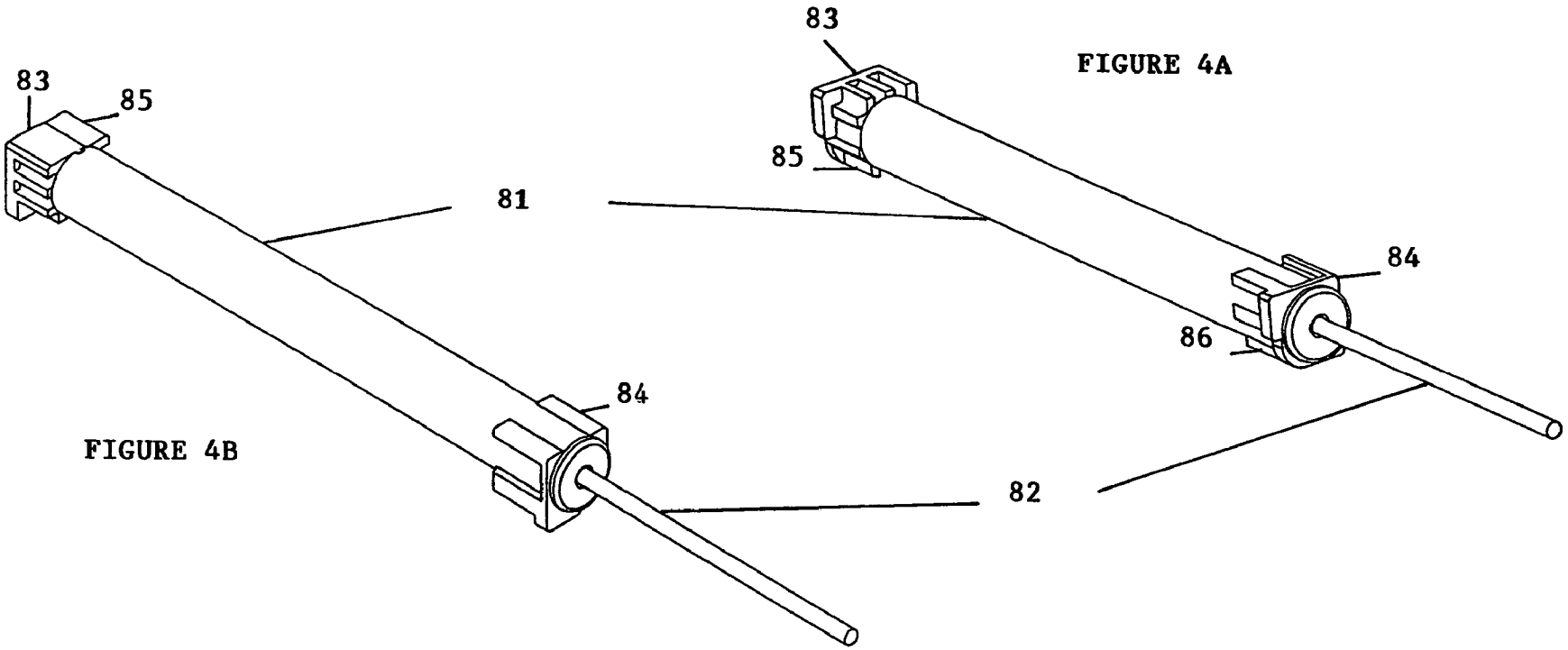
FIGS. 4A and 4B shows a damping device for use in the first embodiment of this invention.
Figure 5A:
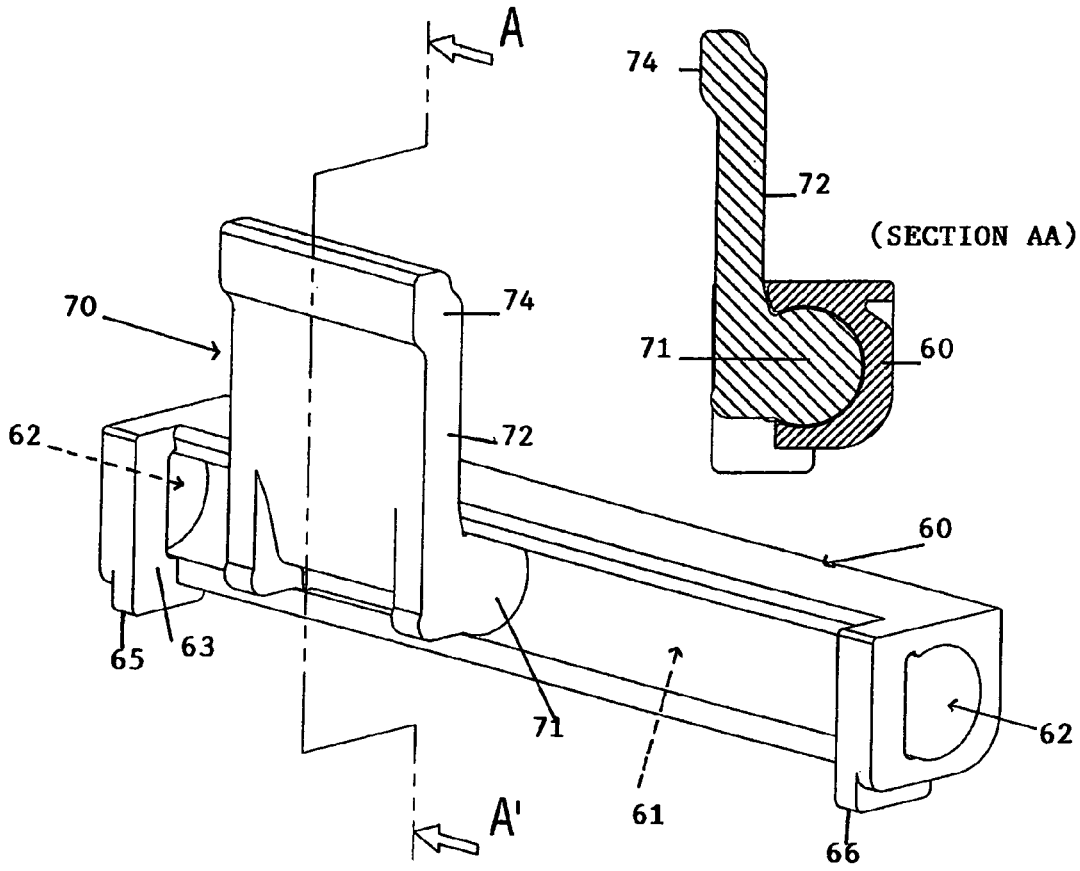
FIGS. 5A and 5B are front and rear perspective views respectively of a channel guide with sliding member of the first embodiment of this invention.
Figure 5B:
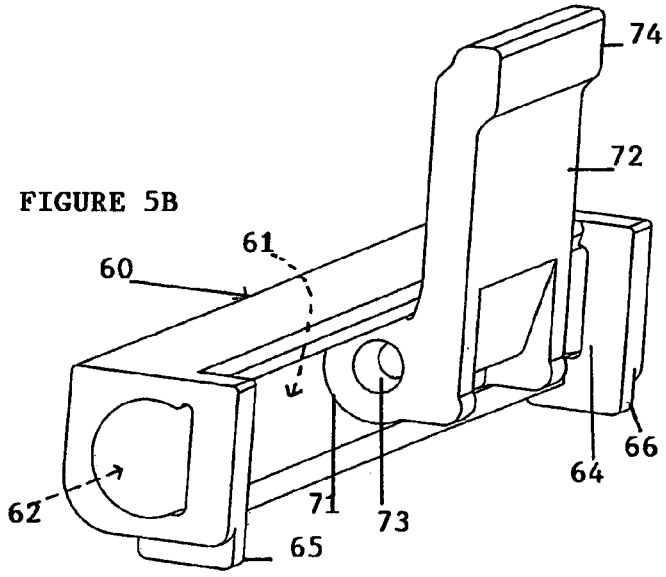

The damping device 80, as shown in FIGS. 4A and 4B, is resiliently compressible in a lengthwise direction and comprises a cylinder body 81 with a rod 82 that is pushable into the cylinder body 81 when the device is compressed. The damping device 80 is oriented such that the distal end of the rod 82 is locatable in the sliding member 70 of the channel guide 60. A pair of attachment brackets 83, 84 is provided on the longitudinal ends of the cylinder body 81 with the rear bracket 83 having a protruding tab 85 for engagement with the metal tab and aperture 13, and the front bracket 84 being engagable with a receiving slot 14, of the mounting bracket 10 horizontal flange. As seen in FIGS. 6A and 6B, the damping device 80 is mounted on the mounting bracket 10 by firstly, engaging the rear attachment bracket 83 via its protruding tab 85 with the metal tab-aperture 13 and subsequently, engaging the front bracket 84 within the receiving slot 14. Secondly, a first pair of metal tabs 11 on the vertical flange of the mounting bracket is punched or pushed inwards so as to contact the cylinder body 81 surface towards each longitudinal end. Thus, the damping device 80 is now firmly mounted on the mounting bracket 10. The damping device 80 is preferably a fluid damper in which the fluid may be either gas or liquid.

The channel guide 60, as shown in FIGS. 5A, 5B, 6A and 6B, has a U-shaped channel with an open side 61 and open longitudinal ends 62. The channel guide 60 is mounted on the mounting bracket 10 in front of the damping device 80 and oriented such that the open side 61 is towards the adjacent fixed rail 20. The open side 61 of this U-shaped channel 60 is set in from the open longitudinal ends 62 such that a pair of vertical stop faces 63, 64 is defined at each longitudinal end. The bottom portion of these vertical stop faces 63, 64 define a pair of attachment tabs 65, 66 that is engaged into the receiving slots 15 on the horizontal flange of the mounting bracket 10. Subsequently, a second pair of metal tabs 12 on the vertical flange of the mounting bracket 10 is punched or pushed inwards so as to contact the top of the channel guide 60. The channel guide 60 is thus, firmly mounted on the mounting bracket 10. An L-shaped sliding member 70 having a horizontally oriented inner portion 71 and a vertically oriented outer portion 72 is slidably mounted within the channel guide 60. The inner portion 71 of the sliding member 70 has a substantially circular cross section and slides within the channel guide 60 and has a terminal aperture 73 towards the rear open longitudinal end 62 of the channel guide 60 for receiving a distal end of the damping device rod 82. When fully extended, the damping device rod 82 runs along the inner length of the channel guide 60. The sliding member outer portion 72 extends outwardly through the open side 61 of the channel guide 60 and has an angled terminal end 74 that hooks over and slides along an edge of the fixed rail 20. The sliding member 70 is thus, slidable along the fixed rail 20 as well as within the channel guide 60.

Figure 19:
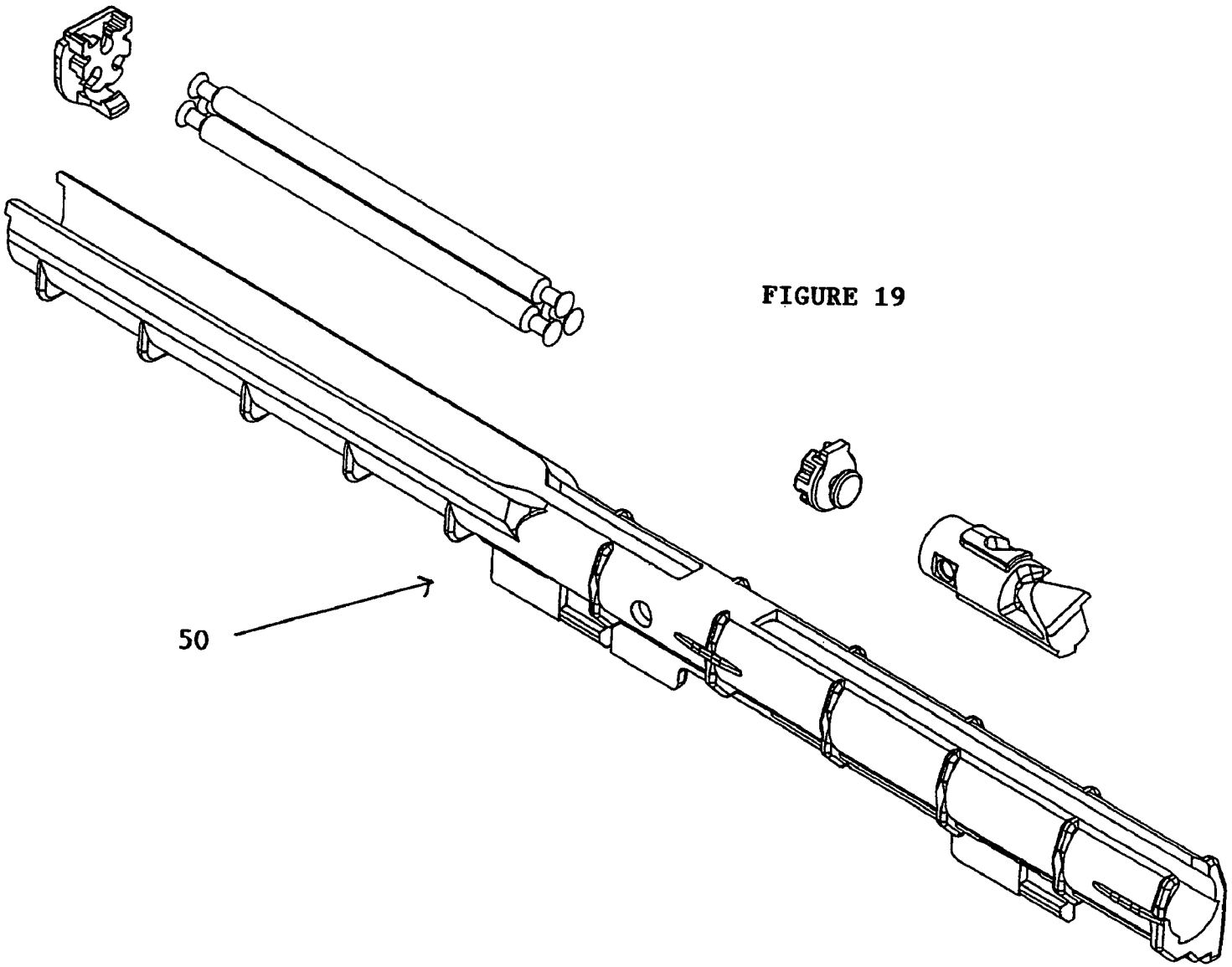
FIG. 19 shows a drawer closing device for use with the guide rail assembly of FIG. 1.

This fixed rail 20, seen in FIGS. 3, 6A and 6B, is formed from sheet metal into an open C-section. Stops consisting of punched-out tabs that are bent inwardly are formed at either or opposite sides towards the longitudinal ends of the rail 20. Slidably fitted inside this fixed rail is a sliding housing (not shown) having rollers wherein this sliding housing runs smoothly on its rollers inside the rail 20 between the stops. The bottom surface of the fixed rail 20 is provided with fastening means (not shown) adapted for mounting on the horizontal flange of the mounting bracket 10. A stopper 21 is also provided on the upper surface of the fixed rail 20 adjacent the assembled damping device-channel guide with sliding member. This stopper 21 is preferably an L-shaped bracket and located at a position on the fixed rail 20 such that the stopper 21 is firstly, set back from the rail side edge and secondly, forward relative to the rear travel limit position (at the rear open longitudinal end 62 of the channel guide 60) of the sliding member 70 within the channel guide 60. The position of the stopper 21 on the fixed rail 20 defines the rear travel limit of the pull out guide 40. Additionally, a drawer closing device 50 is also preferably provided as shown in FIGS. 1 and 19. This closing device 50 is attached at a rear end of the fixed rail 20 and is engagable with a guiding pin 43 provided on the bottom surface of the outer pull out guide 40 so as to aid in the drawer-closing motion i.e. sliding motion of the pull out guide 40 in a drawer-closing direction.

FIGS. 1 and 3 show the intermediate rail 30 formed from sheet metal into a substantially I-section or alternatively a composite of two Ts with upper and lower horizontal flanges and vertical web. The bent edges of the upper and lower flanges are either on the same side as each other or at opposite sides. Two pairs of stops are formed spaced apart on the upper and lower surfaces of the lower and upper flanges respectively that may again consist of inwardly bent punched-out tabs. This intermediate rail 30 may be installed with no distinction as to which end is forward. Also, this rail 30 may be provided with the punched-out tabs of stops not yet bent so that these tabs may be bent in the required direction during assembly or installation. This would allow for flexibility during assembly of this system and also advantageously reduces the number of parts required for stocking.

Also seen in FIGS. 1 and 3 is the outer pull-out guide 40 formed from a sheet metal into an open C-section. On either side of this pull out guide 40 are two stops disposed such that each stop is located towards a longitudinal end of the guide 40. These stops consist of punched-out tabs that bend inwardly. An L-shaped extension 42 is cut or formed on the upper surface of this pull out guide 40. This extension 42 engages with an attachment (not shown) on the drawer side for fixing this pull out guide 40 to the drawer. An aperture 41 is also punched on the upper surface of this pull out guide 40 at the front end (relative to drawer orientation) to allow for engagement with a catch (not shown) mounted at the front of the drawer side. This allows for the drawer to be easily and removably attached with the outer pull out guide 40. Slidably fitted inside this pull out guide is a sliding housing (not shown) having rollers wherein this sliding housing runs smoothly on its rollers inside the pull out guide between the stops. A guiding pin 43 for engagement with the drawer closing device 50 at the rear end of the fixed rail 20 is provided on the bottom surface of the pull out guide 40.

Figure 7A:
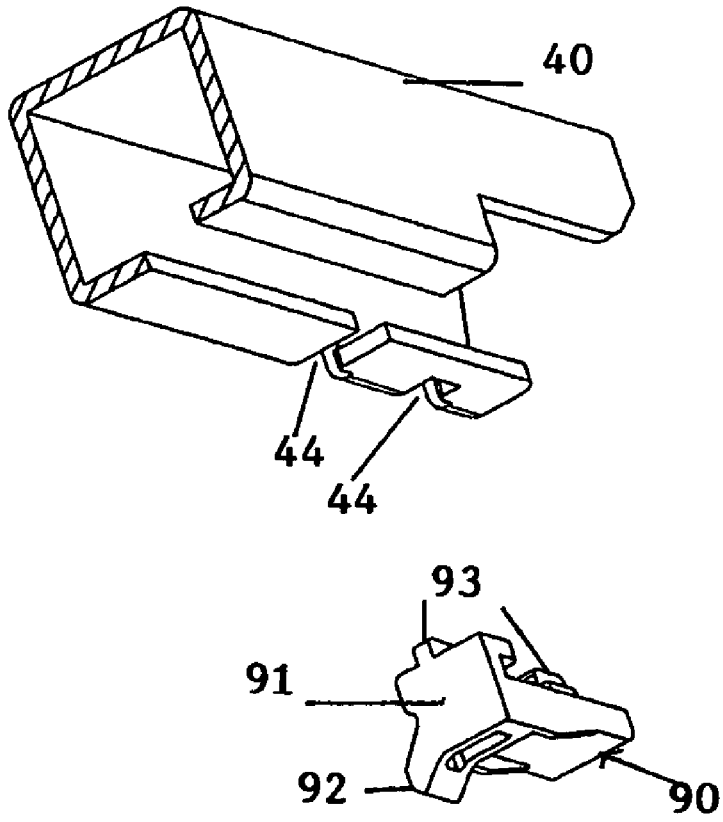
FIG. 7A shows the protrusion detached from the bottom surface of the outer pull out guide of the embodiment of FIG. 1.
Figure 7B:
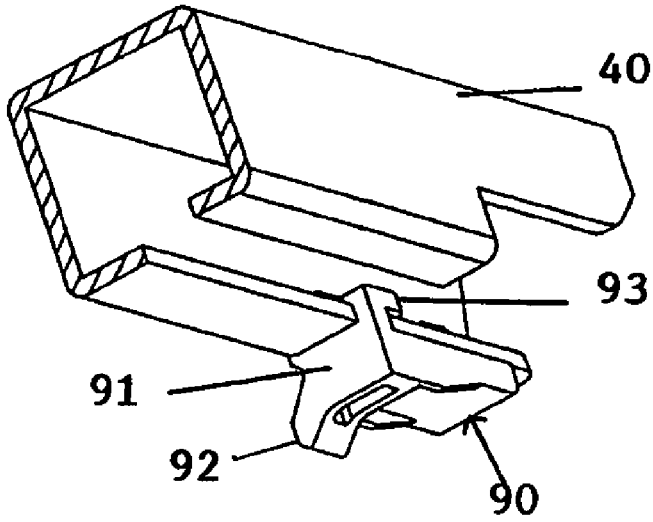
FIG. 7B shows the protrusion removably assembled within the outer pull out guide of the embodiment of FIG. 1.

Additionally, as seen in FIGS. 7A and 7B, this outer pull out guide 40 has a protrusion 90 on its bottom surface disposed toward its front end (relative to drawer orientation) with the protrusion 90 preferably removably mounted on the bottom surface. In this embodiment, the protrusion 90 has a pair of attachment tabs 93 on its top and the bottom surface at a front end of the pull out guide 40 has a pair of corresponding apertures 44 for receiving the protrusion attachment tabs 93. The protrusion 90 is a substantially rectangular block with its front longitudinal end comprising a protruding surface 92 and an abutment surface 91. The protruding surface 92 angles downward and is engagable with the angled terminal end 74 of the sliding member outer portion 72 whereas the abutment surface 91 is engagable with the fixed rail stopper 21 wherein engagement of the abutment surface 91 of the protrusion 90 with the stopper 21 defines the rear travel limit of the pull out guide 40.

The sliding housings of both the fixed rail 20 and outer pull out guide 40 are of a similar construction and comprise a long member having a substantially rectangular cross-section with a hollow central recess in the form of an open T. Rollers are provided at the upper part and both sides of the T. The side rollers are vertically displaced by a distance substantially equal to the thickness of the vertical web of the intermediate rail. The number, type (whether upper or side rollers) and configuration of rollers depend on the load capacity for which the sliding housings are designed. Further side rollers (not shown) that provide lateral guidance for the drawer/equipment may also be provided, wherein when these rollers are spaced as far apart as possible, greater lateral stability is provided. The open T-shaped recess of the intermediate rail-sliding housing enables the intermediate rail 30 to be slidable on the fixed guide 20 with the lower flange of the rail 30 slidably fitted therein. Similarly, the open T-shaped recess of the outer pull out guide-sliding housing enables the pull out guide to be slidable on the intermediate rail 30 with the upper flange of the rail 30 slidably fitted therein. Adequate clearances are provided between the upper rollers and the respective contact surfaces of both the upper and lower flanges of the intermediate rail 30 for ease of alignment and/or assembly. Similarly, adequate clearances are provided between side rollers and the contact surfaces of the vertical web of the intermediate rail 30.

Figure 8:
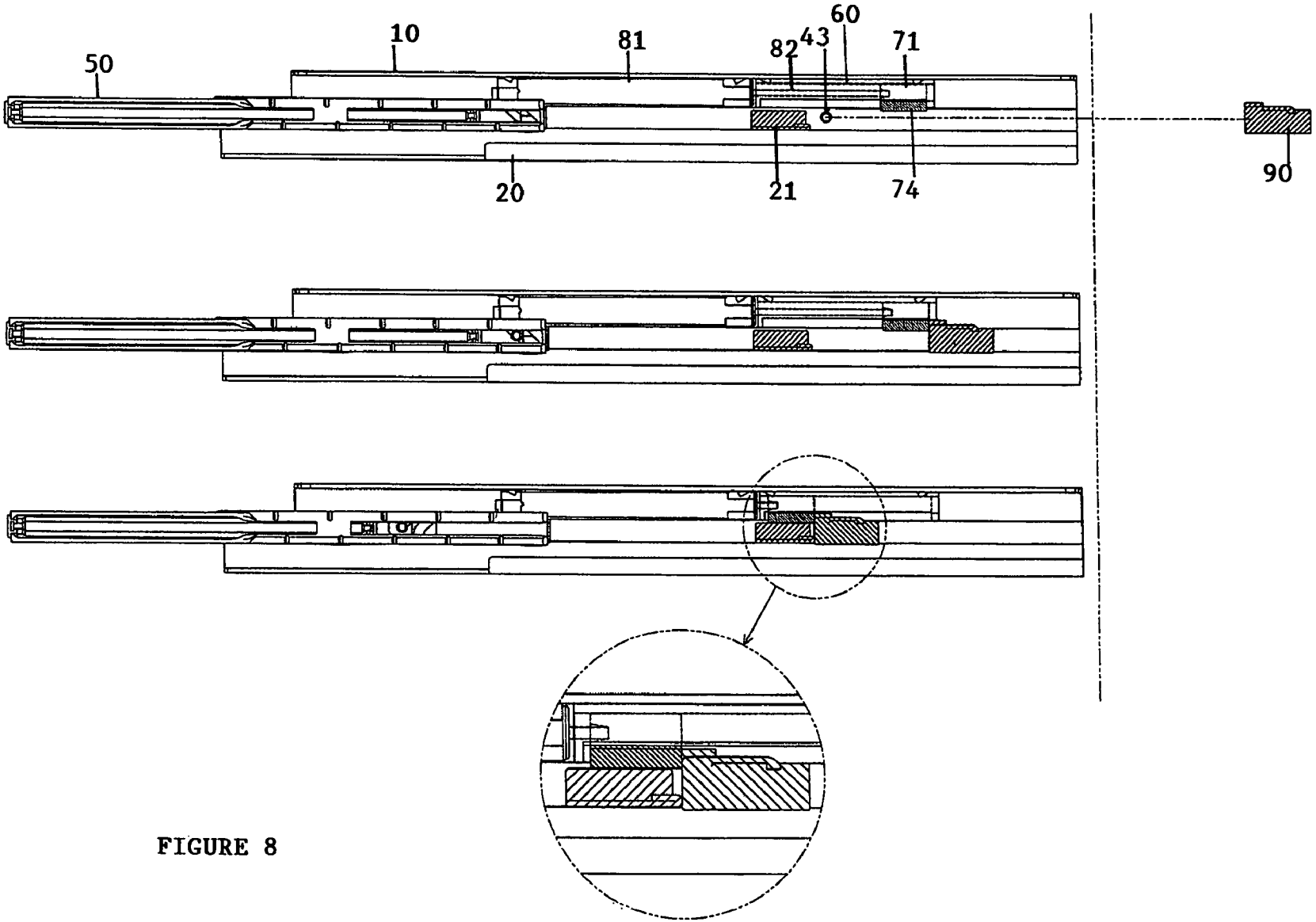
FIG. 8 shows a top view of the guide rail assembly of the embodiment of FIG. 1 as the drawer is initially in a fully opened position and subsequently being pushed into a fully closed position.
Figure 9:
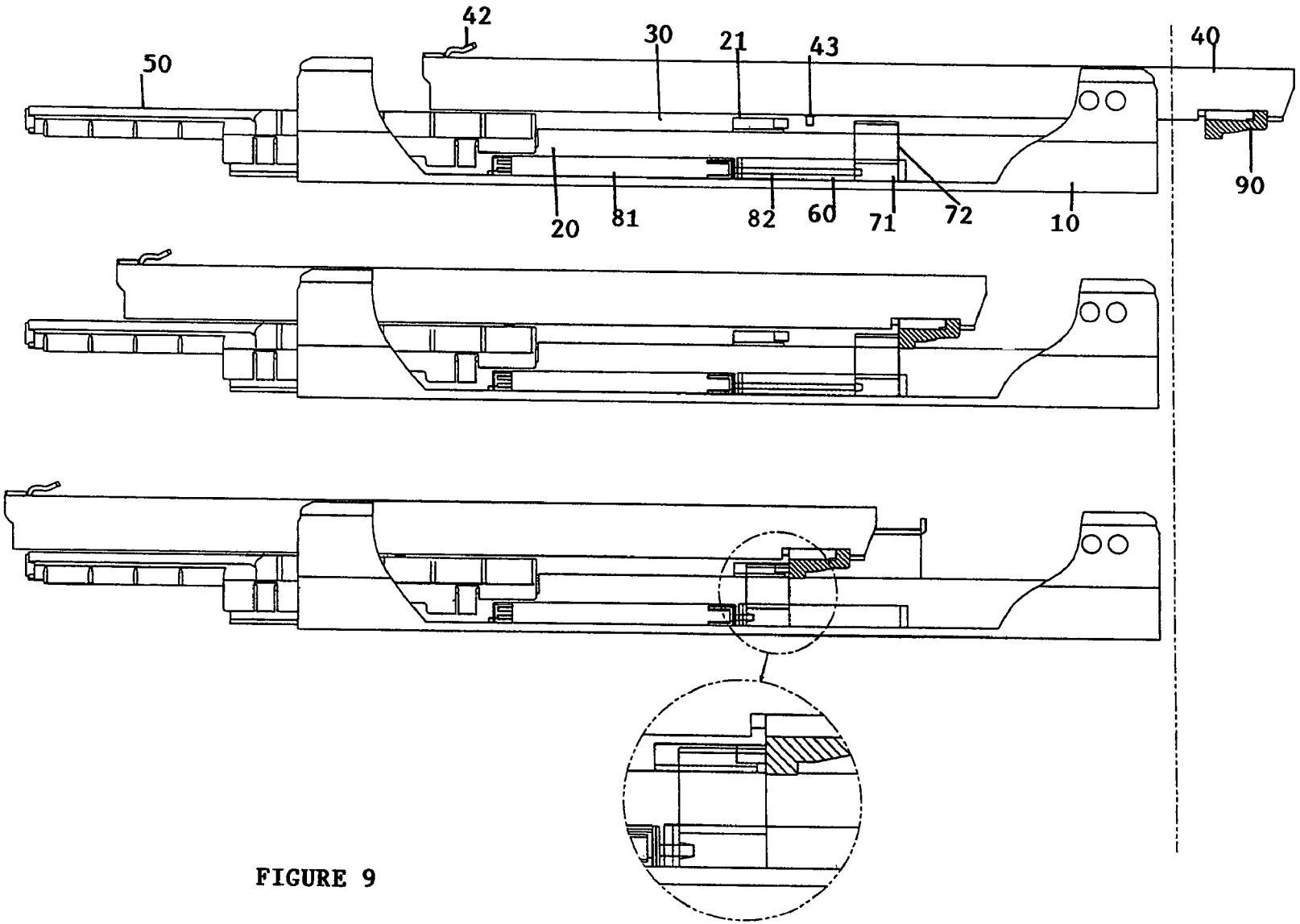
FIG. 9 is a side view of FIG. 8.

In use, as shown in FIGS. 8 and 9, when the drawer is in a fully extended position, the outer pull out guide 40 of the guide rail assembly is in a fully extended position and the sliding member 70 within the channel guide 60 is at its front travel limit abutting against the front vertical stop face 64 of the channel guide 60. In this state, the rod 82 of the damping device 80 with its distal end located within the sliding member inner portion 71 extends along the inner length of the channel guide 60. The outer pull out guide 40 is caused to slide in a drawer-closing direction as the drawer is pushed in. Subsequently, the pull out guide protrusion 90 engages the angled terminal end 74 of the sliding member outer portion 72 via its protruding surface 92 and at the same time, the guiding pin 43 of the pull out guide 40 engages the drawer closing device 50. In this state, the closing action of the guide rail assembly (drawer) is aided by the action of the drawer closing device 50. The engagement of the pull out guide protrusion 90 with the angled terminal end 74 of the sliding member outer portion 72 urges the sliding member inner portion 71 to slidably travel within the channel guide 60. The sliding motion of the sliding member inner portion 71 in turn, causes the damping device 80 to be compressed in a lengthwise direction as the damping device rod 82 located within the inner portion 71 of the sliding member is pushed into the cylinder body 81. Thus, the sliding motion of the sliding member 70 against the resilience of the damping device 80 will result in the deceleration of the drawer-closing motion.

The outer pull out guide 40 having its protrusion 90 engaged with the sliding member 70 of the channel guide 60 continues to slide inward until the drawer is fully closed. The pull out guide 40 sliding motion is halted at its rear travel limit as the abutment surface 91 of its protrusion 90 engages the stopper 21 of the fixed rail 20. In this position, the pull out guide 40 is said to be at its rear travel limit. As the fixed rail stopper 21 is set back from the rail side edge and the sliding member 70 slides along the fixed rail side edge via the angled terminal end 74 of the outer portion 72, the sliding member 70 continues to be slidable even though the pull out guide 40 is at its rear travel limit and as such, stationary. The sliding motion of the sliding member 70 within the channel guide 60 is limited by the inner length of the channel guide 60. In other words, the front vertical stop face 64 of the channel guide 60 defines a front travel limit for the sliding member 70 and the rear vertical stop face 63 defines a rear travel limit.

When the drawer is in a fully closed or pushed-in position, the outer pull out guide 40 of the guide rail assembly is at its rear travel limit with the abutment surface 91 of its protrusion 90 engaged with the fixed rail stopper 21 and its guiding pin 43 engaged with the drawer closing device 50. The damping device 80 is in a compressed state (majority length of the rod 82 with its distal end located within the sliding member inner portion 71 pushed into cylinder body 81) and the angled terminal end 74 of the sliding member outer portion 72 is in contact with the protruding surface 92 of the pull out guide protrusion 90. As the drawer is pulled out, the outer pull out guide 40 is caused to slide in a drawer-opening direction resulting in the pull out guide guiding pin 43 being disengaged from the drawer closing device 50 and the protruding surface 92 of the pull out guide protrusion 90 being disengaged from the angled terminal end 74 of the sliding member outer portion 72. The damping device 80 will now be allowed to decompress in a lengthwise direction due to its resilient nature and the rod 82 will be pushed out of its cylinder body 81. As the distal end of the rod 82 is located within the sliding member inner portion 71, decompression of the damping device 80 will urge the forward sliding motion of the sliding member 70 within the channel guide 60 until it reaches its front travel limit.

In another embodiment of this invention seen in FIGS. 10 to 18, the construction of the outer pull guide sliding housings and damping device 80 of the guide rail assembly and manner of attachment to an article of furniture (or other enclosure) and drawer are similar to the above-described first embodiment. The construction of the mounting bracket 100, fixed rail 200, intermediate rail 300, pull out guide protrusion 900 and channel guide 600 with sliding member 700 of this aspect differs from that of the first embodiment.

As shown in FIGS. 10, 12, 15A and 15B, the mounting bracket 100 of this embodiment is formed from sheet metal into an L-section with the upper free edge of the horizontal flange of the L-section bent upwardly to form a fixed rail 200 having a T-cross section. The height of the fixed rail 200 is significantly less than the height of the vertical flange of the L-section mounting bracket 100. The T-shaped fixed rail 200 also has a folded up metal tab 220 at its rear longitudinal end (relative to drawer orientation) that functions as a limit stopper for the sliding housing (as described above) that slides thereon. As in the first embodiment, the vertical flange of the mounting bracket 100 is provided with a multitude of holes for fixing to the side of an article of furniture. Similarly, the vertical flange has stepped edges formed thereon and notches at the bent edge of the L-section for increasing the rigidity and load capacity of this mounting bracket 100. The damping device 800 and channel guide 600 with sliding member 700 are longitudinally mounted on the horizontal flange of the mounting bracket 100 adjacent the fixed rail 200.

Figure 10:
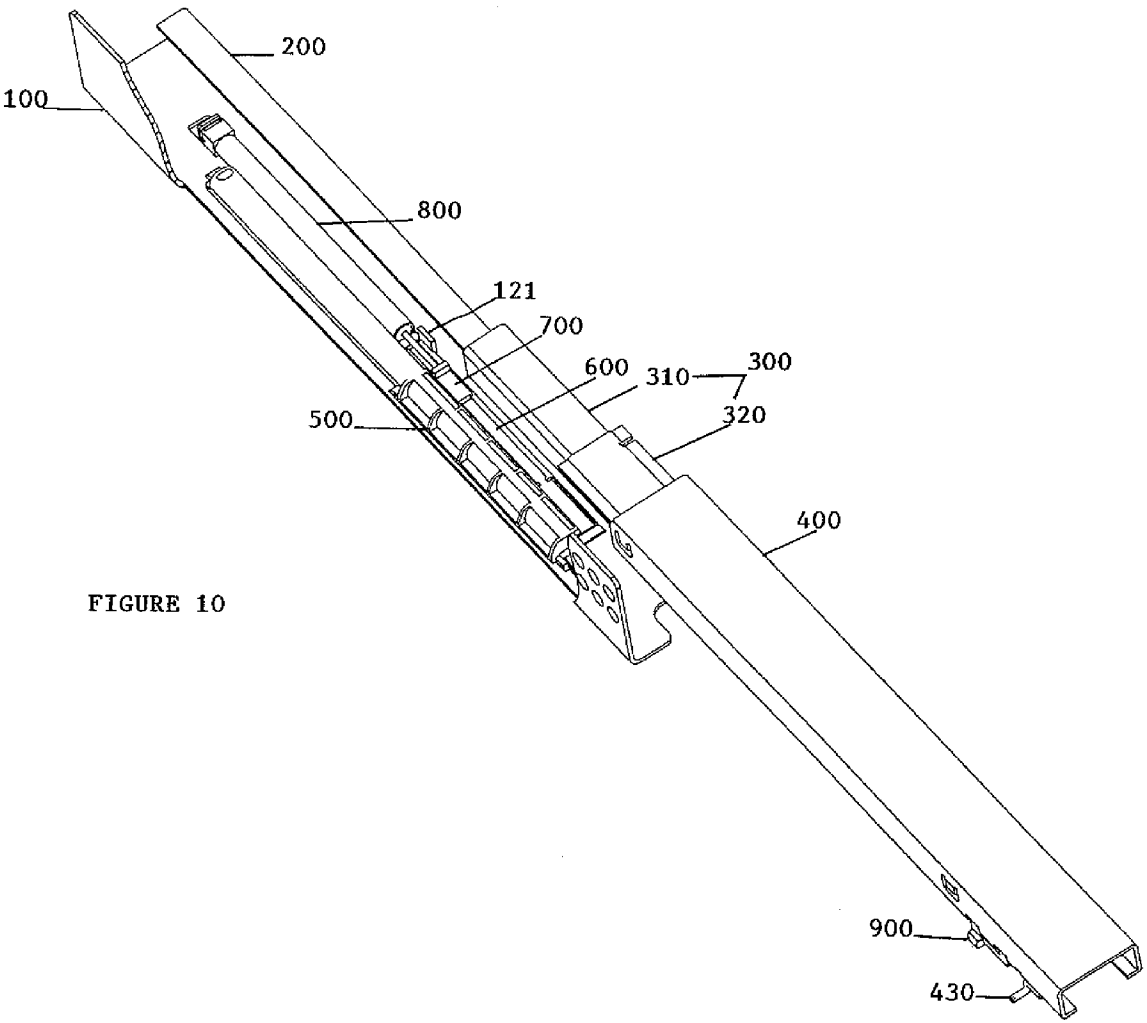
FIG. 10 shows a perspective view of the guide rail system according to another embodiment of the invention with part of the vertical flange of the mounting bracket not shown.
Figure 11:
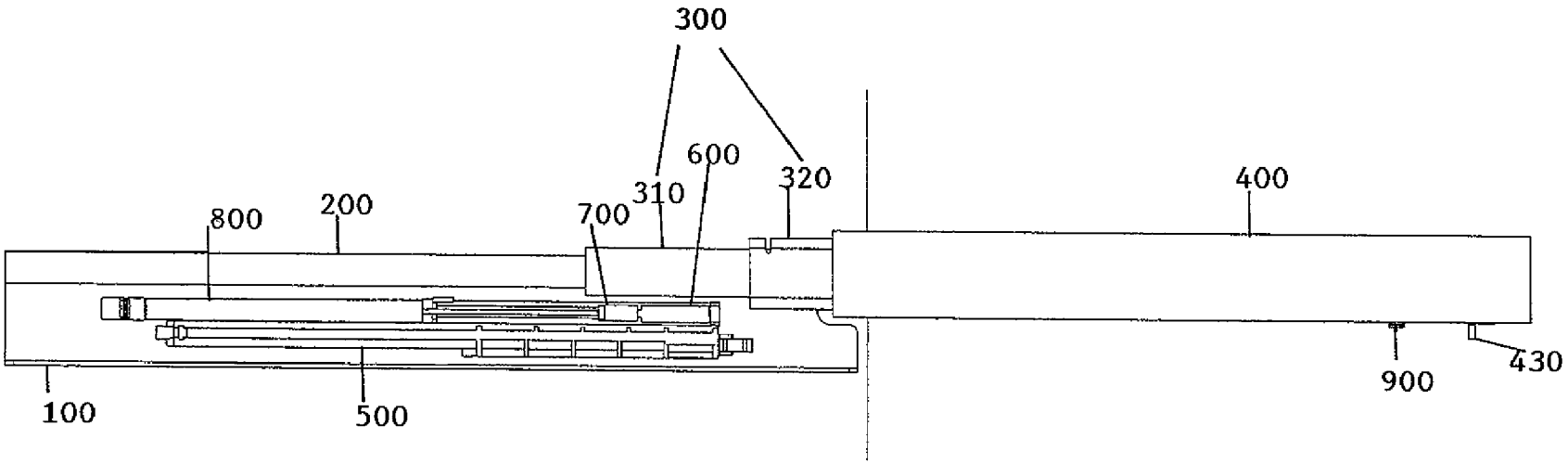
FIG. 11 is a top view of FIG. 10.

Again, both the damping device 800 and channel guide 600 with sliding member 700 are located longitudinal end to longitudinal end relative to each other with the damping device 800 in a rear position and the channel guide 600 in a front position, both rear and front positions being relative to drawer orientation within the article. A pair of apertures with retainer pieces 114 is provided on the horizontal flange of the L-section for firmly holding the channel guide 600 thereon. For holding the damping device 800 on the horizontal flange, a similar aperture with retainer piece 117 is also provided together with a retaining hole 115 and tab 116. Additionally, a stopper 121 is also provided on the horizontal flange of the L-section adjacent and between the channel guide 600 and T-shaped fixed rail 200. The stopper 121 is located such that it is forward relative to the rear travel limit position of the sliding member 700 within the channel guide 600. Additionally, in this embodiment, a drawer closing device 500, as shown in FIG. 10, is preferably provided on the horizontal flange between the vertical flange and the longitudinal arrangement of the damping device 800 and channel guide 600. Similarly as in the first embodiment, the closing device 500 aids in the drawer-closing motion i.e. sliding motion of the pull out guide 400 in a drawer-closing direction.

Figures 13A, 13B:
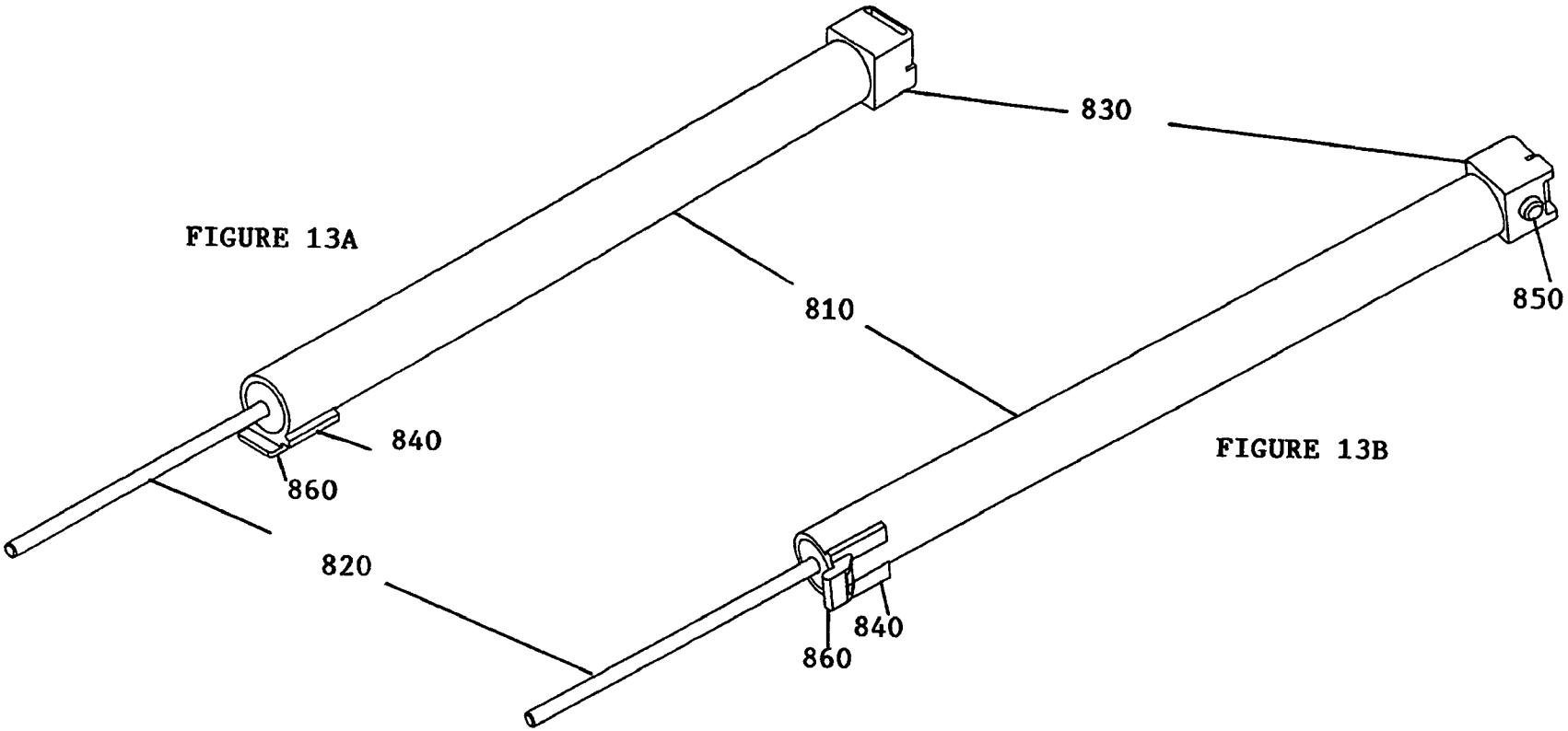
FIGS. 13A and 13B shows a damping device for use in the embodiment of FIG. 10.

As seen in FIGS. 13A and 13B, the damping device 800 of this embodiment is substantially similar to that of the first embodiment with the exception that the pair of attachment brackets 830, 840 provided on each longitudinal end of the cylinder body 810 differ in construction. The rear bracket 830 has a button-like protrusion 850 for engagement with the corresponding retaining hole 115, and the front bracket 840 is engagable with a corresponding receiving aperture 117, of the mounting bracket 100 horizontal flange. The damping device 800 is mounted on the mounting bracket 100 by firstly, engaging the rear attachment bracket 830 via its button-like protrusion 850 with the retaining hole 115 wherein in this position the rear longitudinal end of the cylinder body 810 of the damping device 800 abuts the retaining tab 116. Subsequently, front bracket 840 is engaged within the receiving aperture with retaining piece 117. Thus, the damping device 800 is now mounted on the mounting bracket 100. As in the first embodiment, the damping device 800 is preferably a fluid damper in which the fluid may be either gas or liquid.

Figure 14A:
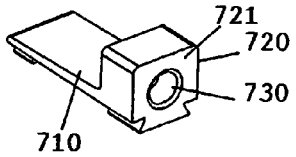
FIG. 14A are front and rear perspective views of a sliding member slidably mounted within a channel guide of the embodiment of FIG. 10.
Figure 14B:
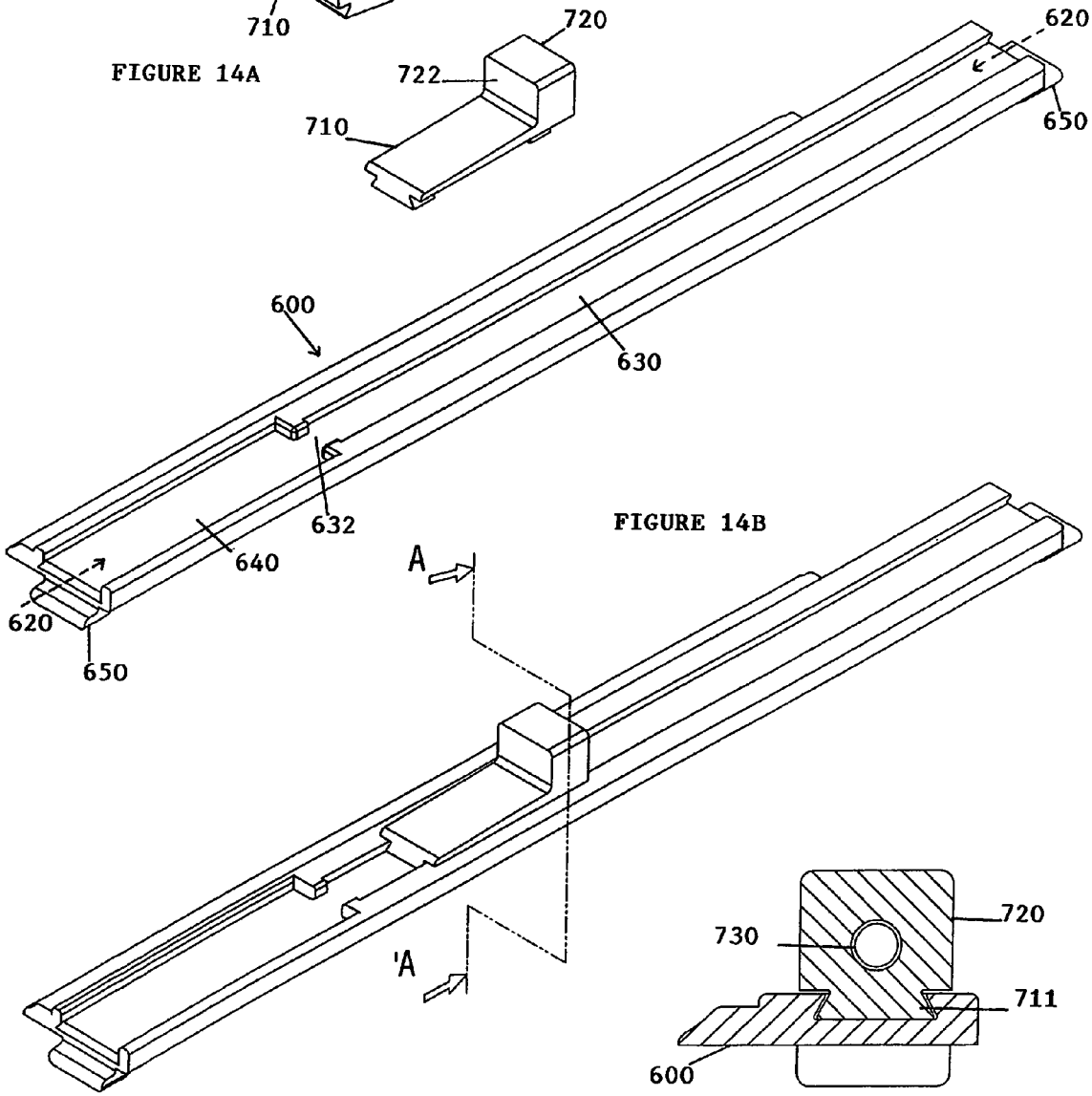
FIG. 14B shows a channel guide with sliding member of FIG. 14A mounted thereon of the embodiment of FIG. 10.
Figure 15A:
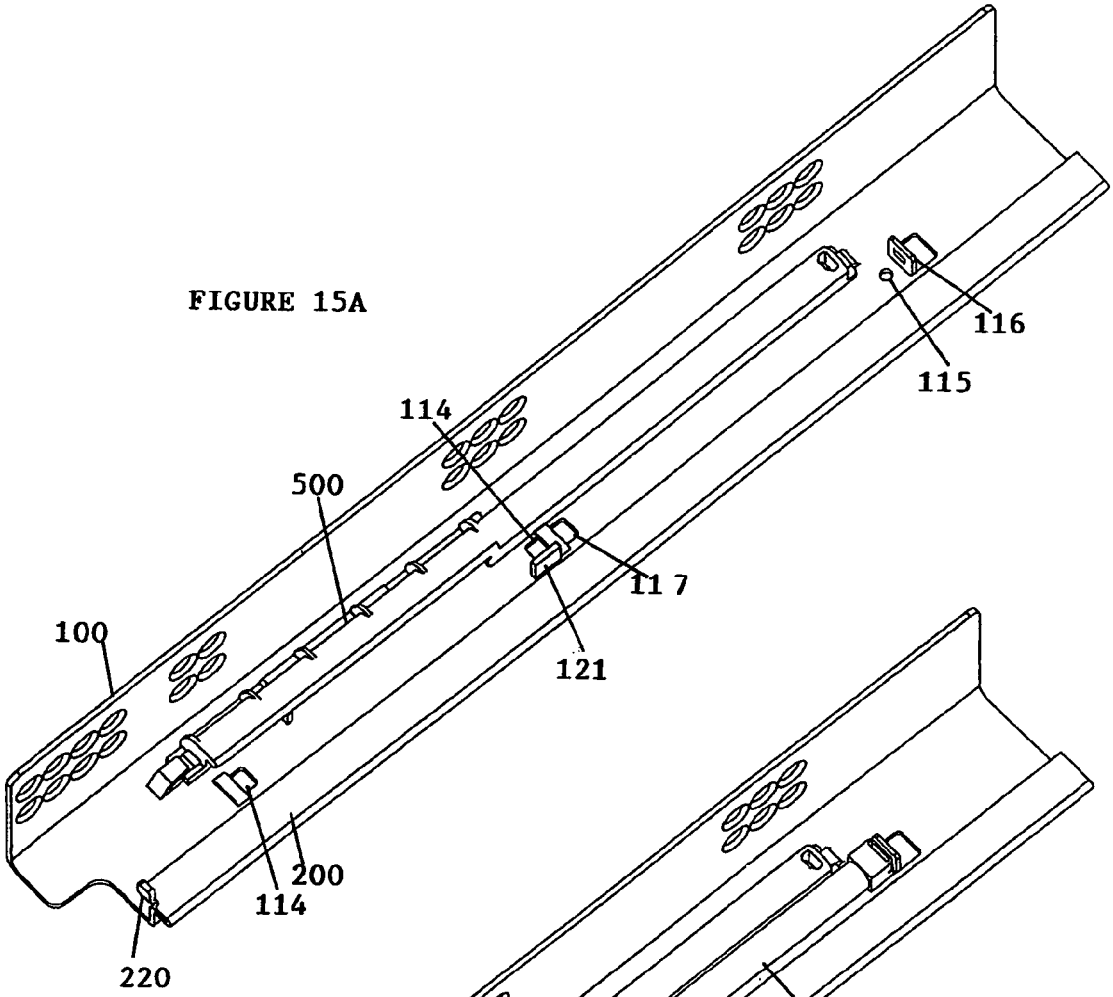
FIGS. 15A and 15B shows the manner of mounting a damping device and channel guide with sliding member onto a mounting bracket of FIG. 10.
Figure 15B:
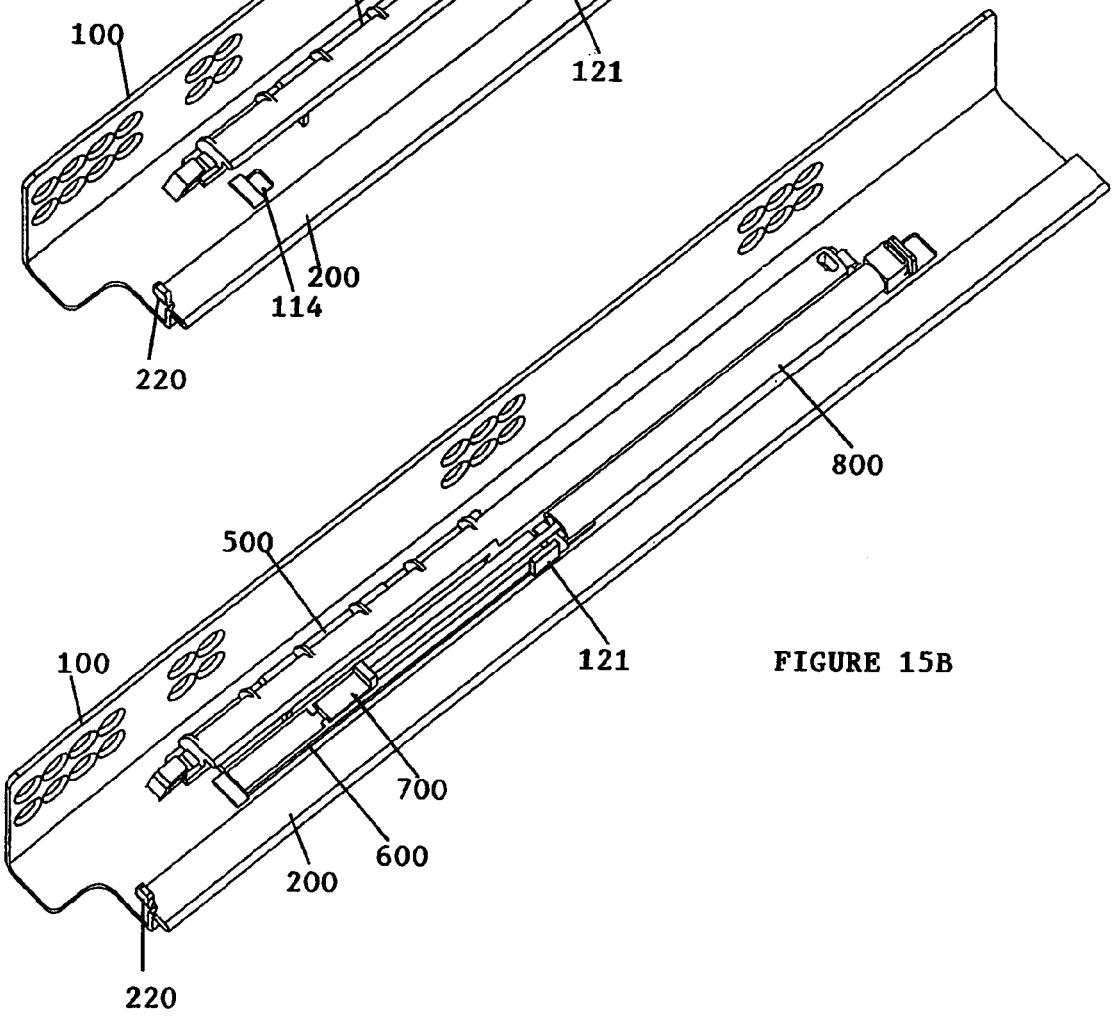

In this embodiment, as seen in FIGS. 14A and 14B, the channel guide 600 is a substantially rectangular elongate channel with an open top 610 and open longitudinal ends 620. This channel guide 600 comprises a narrow channel portion 630, where the sliding member 700 is slidably mounted thereon, and a wider channel portion 640. The length of the narrower portion 630 is substantially greater than that of the wider portion 640. The channel guide 600 is oriented such that it is mounted on the mounting bracket 100 horizontal flange with the narrower channel portion 630 in the rear (towards the damping device 800) and the wider channel portion 640 in the front, with both rear and front being relative to drawer orientation. The open rear longitudinal end of the narrower channel portion 630 faces the rod 820 of the damping device 800. A pair of attachment tabs 650 terminally protruding from the longitudinal ends of the channel guide 600 is engaged into the corresponding receiving apertures 114 on the horizontal flange of the mounting bracket 100. The channel guide 600 is thus, firmly mounted on the mounting bracket 100. The sliding member 700 is L-shaped with a vertically oriented outer portion 720 and a horizontally oriented inner portion 710 that is slidably mounted within the narrower channel portion 630 of the channel guide 600. The inner portion 710 of the sliding member 700 has a wedge-like bottom 711 that is slidable along the narrow channel portion 630 of the channel guide 600. The vertically oriented sliding member outer portion 720 extends upwardly through the open top 610 of the channel guide 600 and has two vertical faces 721, 722. The rear vertical face 721 is provided with an aperture 730 for receiving the distal end of the damping device rod 820 and the front vertical face 722 is engagable with the protruding surface 920 of the outer pull out guide protrusion 900. When fully extended, the damping device rod 820 runs along the length of the narrower channel portion 630 of the channel guide 600.

Figure 12:
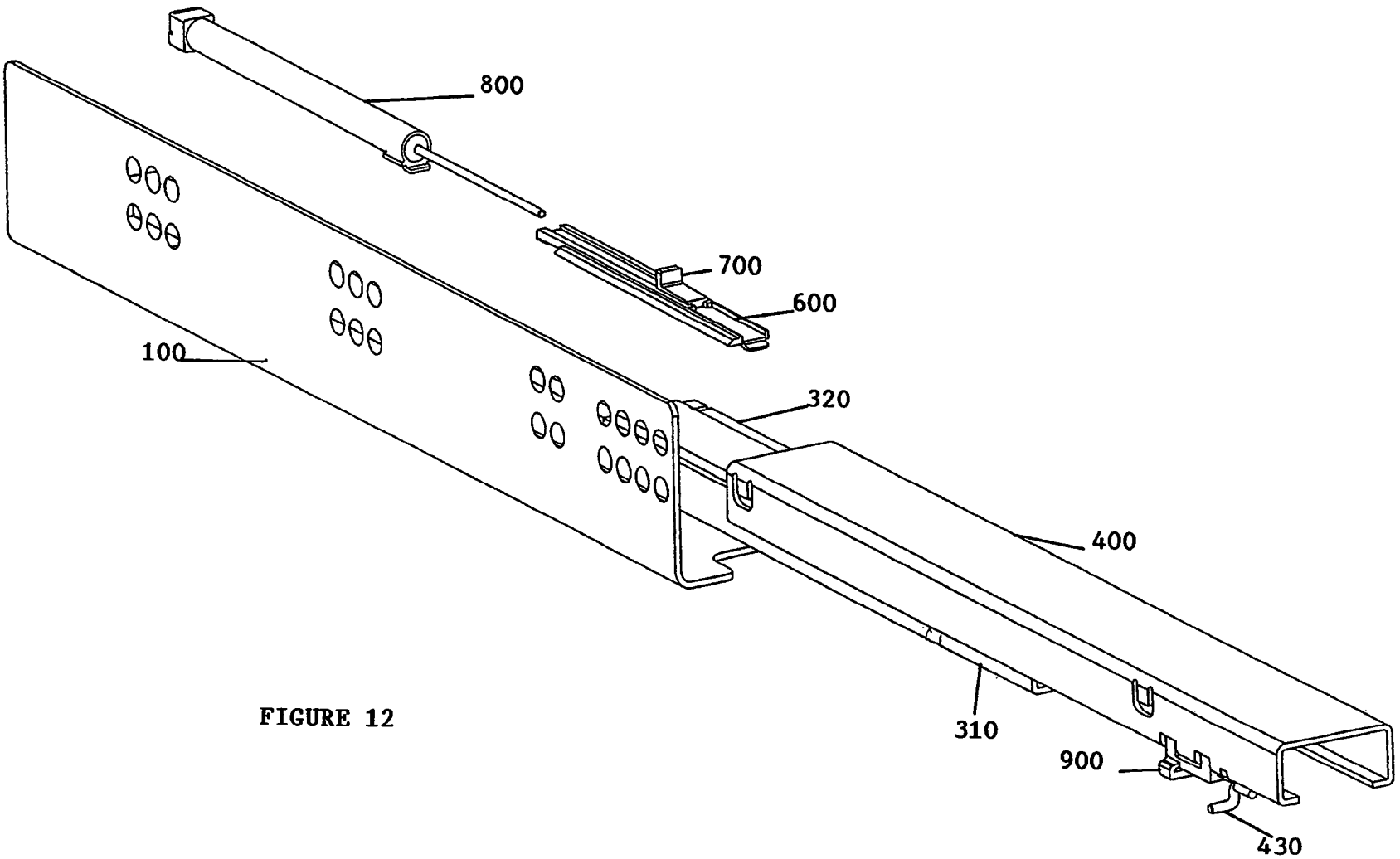
FIG. 12 an exploded view of FIG. 10.

The intermediate rail 300 of this aspect seen in FIGS. 10 and 12 consists of an open C-shaped guide 310 having unequal sides that is slidable along the mounting bracket fixed rail 200 and a channel piece 320 disposed on top of the C-shaped guide 310. At the upper and rear ends of each side of the C-shaped guide 310 is a punched out tab (not shown) that extends inwards and serves as a travel limit stopper for the fixed rail sliding housing (not shown). The channel piece 320 is preferably a substantially planar metal plate that is detachably mounted on top of the C-shaped guide 310 and slidably receives the outer pull out guide 400 thereon. Also, the channel piece 320 has slightly inclined sides that define a shoulder on each side for guiding and stabilizing the sliding motion of the outer pull out guide 400. The width of this channel piece 320 is therefore, preferably considerably more than that of the C-shaped guide 310 but slightly less than that of the outer pull out guide 400. A punched out tab functioning as a limit stopper for the sliding housing of the outer pull out guide 400 is also provided at the upper end of the channel piece 320.

Figure 16A:
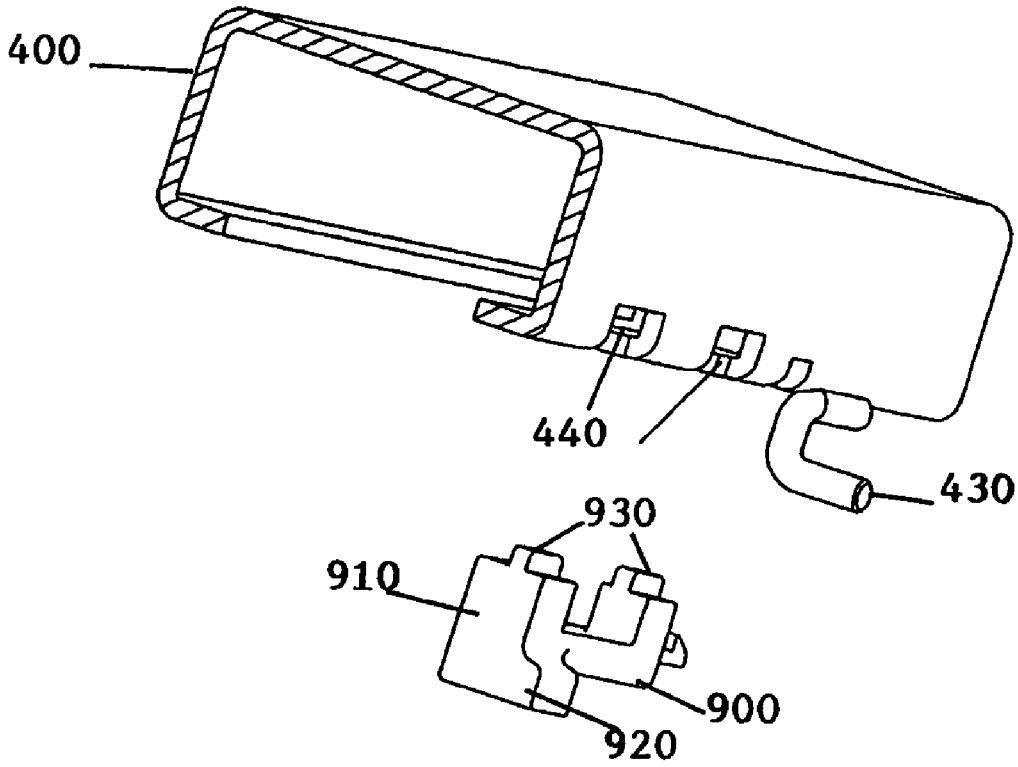
FIG. 16A shows the protrusion detached from the bottom surface of the outer pull out guide of the embodiment of FIG. 10.
Figure 16B:
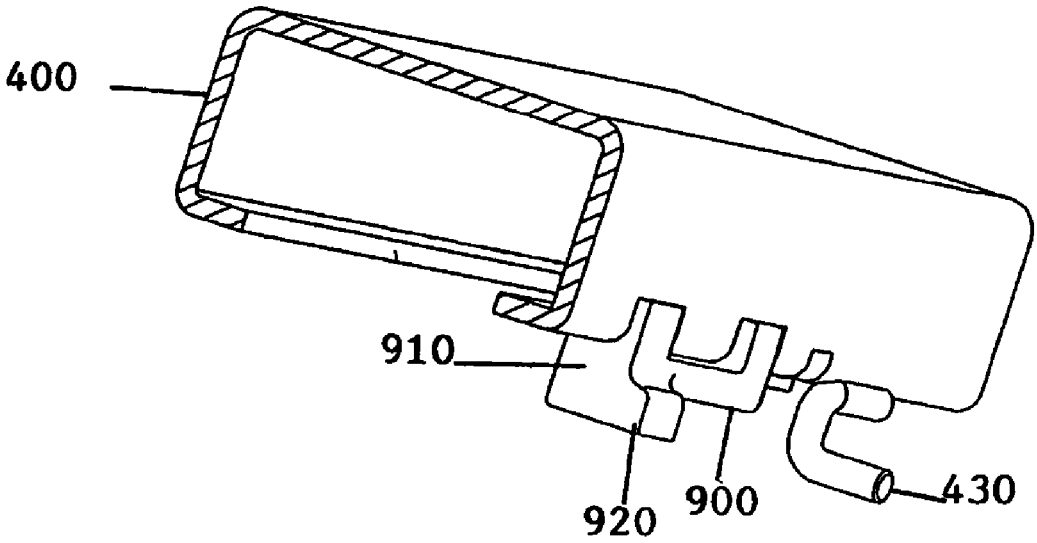
FIG. 16B shows the protrusion removably assembled within the outer pull out guide of the embodiment of FIG. 10.

As seen in FIGS. 10 and 12, the outer pull out guide 400 of this aspect is of a similar construction and function as that described in the first embodiment. A guiding pin 430 for engagement with the drawer closing device 500 on the horizontal flange of the mounting bracket 100 is provided on the bottom surface of the pull out guide 400. FIGS. 16A and 16B show a protrusion 900 also provided on the pull out guide bottom surface disposed toward its front end (relative to drawer orientation) with the protrusion 900 preferably removably mounted on the bottom surface. Similar as in the first embodiment, the protrusion 900 has a pair of attachment tabs 930 on its top and the pull out guide 400 bottom surface (front end of pull out guide 400) has a pair of corresponding apertures 440 for receiving the protrusion attachment tabs 930. In this embodiment, the protrusion 900 is a substantially C-shaped bracket with its front longitudinal end comprising a protruding surface 920 and an abutment surface 910. The protruding surface 920 extends perpendicularly sideways from the abutment surface 910 and is engagable with the outer portion 720 of the sliding member 700 whereas the abutment surface 910 is engagable with the mounting bracket stopper 121 wherein engagement of the protrusion abutment surface 910 with the stopper 121 defines the rear travel limit of the pull out guide 400.

Figure 17:
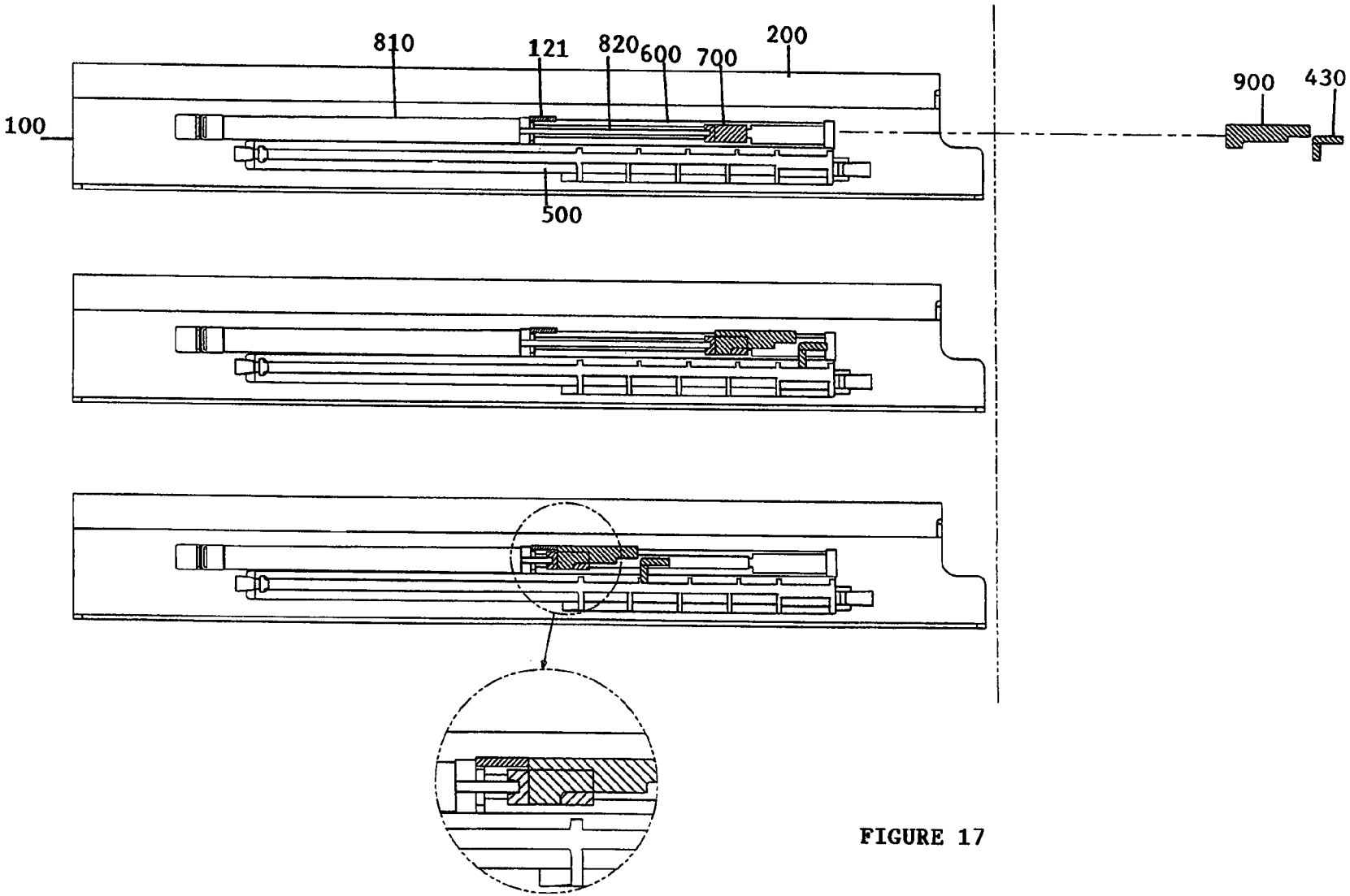
FIG. 17 shows a top view of the guide rail assembly of the embodiment of FIG. 10 as the drawer is initially in a fully opened position and subsequently being pushed into a fully closed position.
Figure 18:
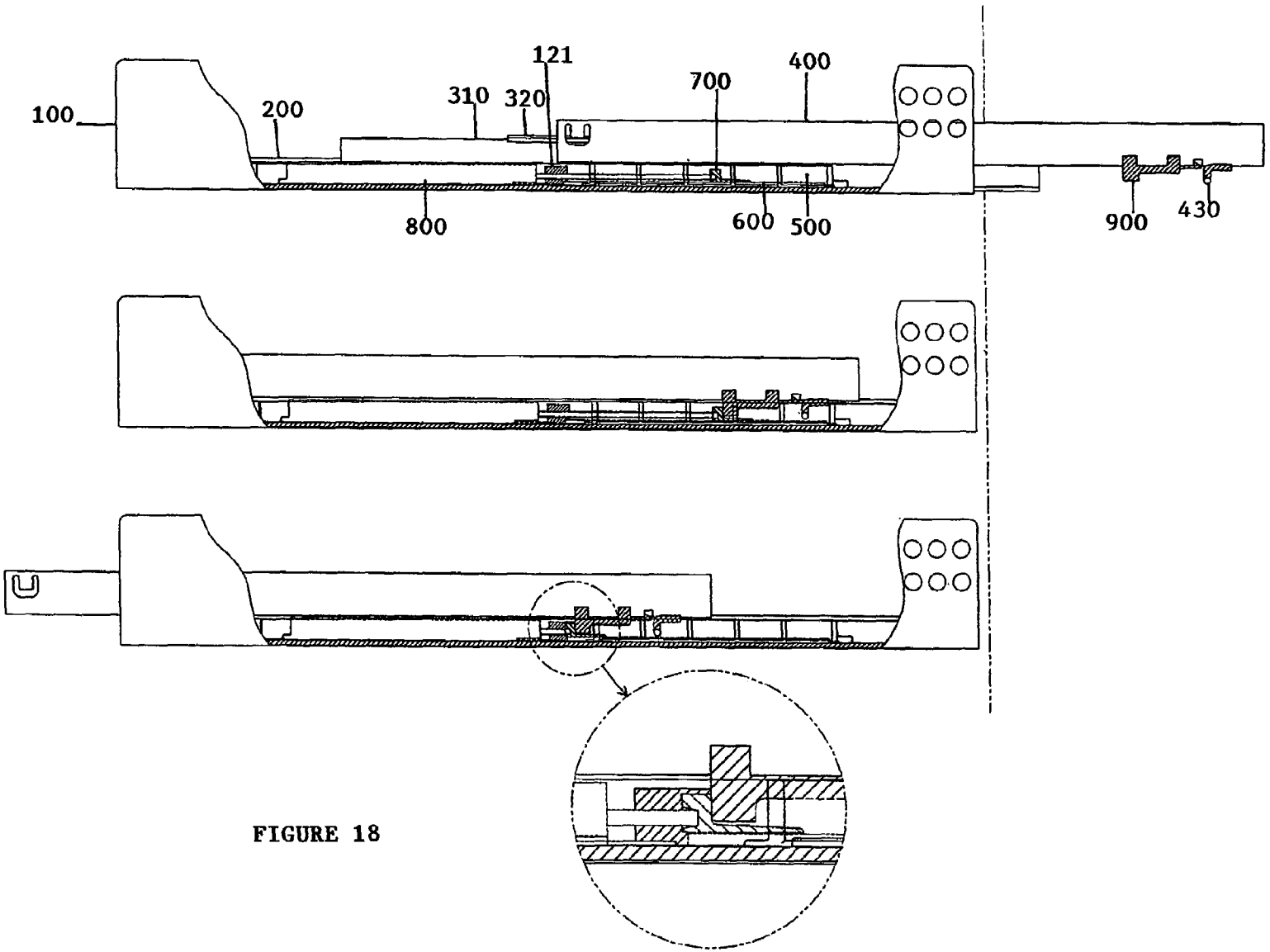
FIG. 18 is a side view of FIG. 17.

FIGS. 17 and 18 show, in use, when the drawer is in a fully extended position, the outer pull out guide 400 of the guide rail assembly is in a fully extended position and the sliding member 700 within the channel guide 600 is at its front travel limit, defined by the differing width between the narrower and wider channel portions 630, 640 of the channel guide 600. In this state, the rod 820 of the damping device 800 with its distal end located within the sliding member 700 runs along the length of the narrower channel portion 630 of the channel guide 600. The outer pull out guide 400 is caused to slide in a drawer-closing direction as the drawer is pushed in. Subsequently, the pull out guide protrusion 900 engages the front vertical face 722 of the sliding member outer portion 720 via its protruding surface 920 and at the same time, the guiding pin 430 of the pull out guide 400 engages the drawer closing device 500. In this state, the closing action of the guide rail assembly (and so of the drawer) is aided by the action of the drawer closing device 500. The engagement of the pull out guide protrusion 900 with the front vertical face 722 of the sliding member outer portion 720 urges the sliding member inner portion 710 to slidably travel within the narrower channel portion 630 of the channel guide 600. The sliding motion of the sliding member inner portion 710 in turn, causes the damping device 800 to be compressed in a lengthwise direction as the damping device rod 820 located within the rear vertical face 721 of the sliding member outer portion 720 is pushed into the cylinder body 810. Thus, the sliding motion of the sliding member 700 against the resilience of the damping device 800 will result in the deceleration of the drawer-closing motion.

The outer pull out guide 400 having its protrusion 900 engaged with the sliding member 700 of the channel guide 600 continues to slide inward until the drawer is fully closed. The pull out guide 400 sliding motion is halted at its rear travel limit as the abutment surface 910 of its protrusion 900 engages the stopper 121 of the mounting bracket 100. In this position, the pull out guide 400 is said to be at its rear travel limit. Due to the location of the mounting bracket stopper 121 such that it is forward relative to the rear travel limit position of the sliding member 700, the sliding member 700 continues to be slidable even though the pull out guide 400 is at its rear travel limit and as such, stationary. The difference in width between the narrower channel portion 630 and wider channel portion 640 of the channel guide 600 defines a front travel limit 632 for the sliding member 600 whereas the mounting bracket retaining piece 116 defines a rear travel limit.

When the drawer is in a fully closed or pushed-in position, the outer pull out guide 400 of the guide rail assembly is at its rear travel limit with the abutment surface 910 of its protrusion 900 engaged with the mounting bracket stopper 121 and its guiding pin 430 engaged with the drawer closing device 500. The damping device 800 is in a compressed state (majority length of the rod 820 with its distal end located within the sliding member outer portion 720 pushed into cylinder body 810) and the front vertical face 722 of the sliding member outer portion 720 is in contact with the protruding surface 920 of the pull out guide protrusion 900. As the drawer is pulled out, the outer pull out guide 400 is caused to slide in a drawer-opening direction resulting in the pull out guide guiding pin 430 being disengaged from the drawer closing device 500 and the protruding surface 920 of the pull out guide protrusion 900 being disengaged from the front vertical face 722 of the sliding member outer portion 720. The damping device 800 will now be allowed to decompress in a lengthwise direction due to its resilient nature and the rod 820 will be pushed out of its cylinder body 810. As the distal end of the rod 820 is located within the rear vertical face 721 of the sliding member outer portion 720, decompression of the damping device 800 will urge the forward sliding motion of the sliding member 700 within the narrower channel portion 630 of the channel guide 600 until it reaches its front travel limit.

As will be readily apparent to those skilled in the art, the present invention may easily be produced in other specific forms without departing from its scope or essential characteristics. The present embodiments are, therefore, to be considered as merely illustrative and not restrictive, the scope of the invention being indicated by the claims rather than the foregoing description, and all changes which come within therefor intended to be embraced therein.

The invention claimed is:

1. A guide rail assembly for slidably opening and closing a drawer within an enclosure, the assembly comprising:

a mounting bracket for fixing said assembly to the enclosure, said mounting bracket having a fixed rail for receiving an intermediate rail, an intermediate rail slidably engaging said fixed rail, an outer pull out guide for attachment to the drawer, slidably engaging said intermediate rail relative to said intermediate rail and said fixed rail, a protrusion on the bottom surface of the outer pull out guide, a damping device and a channel guide disposed along the mounting bracket adjacent said fixed rail, said damping device being resiliently compressible in a lengthwise direction and said channel guide having a sliding member, the sliding member including an inner portion that travels within the guide and an outer portion that extends outwardly from the guide so as to be contactable by said pull out guide protrusion, said inner portion locating an end of the damping device that can be pushed inwardly to provide damping, said fixed rail having a stopper defining a rear travel limit of the pull out guide, said stopper located such that it is forward relative to a rear travel limit position of the sliding member within the channel guide;

whereby, during a closing action of the assembly, the outer pull out guide is caused to slide in a drawer-closing direction and when said protrusion reaches and contacts the sliding member outer portion, the sliding member travels within said channel guide against the resilience of said damping device and causes deceleration of the drawer-closing motion; and whereby, during a closing action of the assembly, the stopper engages and stops the pull out guide before the sliding member reaches the rear travel limit within the channel guide.

2. A guide rail assembly as claimed in claim 1, wherein said damping device comprises a cylinder body and a rod that is pushable into the cylinder body when the device is compressed, the distal end of the rod being located in the sliding member inner portion.

3. A guide rail assembly as claimed in claim 1, wherein said damping device is a fluid damper.

4. A guide rail assembly as claimed in claim 1, wherein said channel guide is a U-shaped channel having an open side and open longitudinal ends such that the sliding member outer portion extends outwardly through the open side of the channel guide and the sliding member inner portion receives said end of the damping device through a channel open longitudinal end.

5. A guide rail assembly as claimed in claim 1, wherein said sliding member inner portion further comprises an aperture for receiving said end of the damping device.

6. A guide rail assembly as claimed in claim 1, wherein said stopper is an L-shaped bracket.

7. A guide rail assembly as claimed in claim 1, wherein said outer pull out guide protrusion further comprises a protruding surface and an abutment surface, said protruding and abutment surfaces engagable with the outer portion of said sliding member and said fixed rail stopper respectively.

8. A guide rail assembly for slidably opening and closing a drawer within an enclosure, the assembly comprising:

a mounting bracket for fixing said assembly to the enclosure, said mounting bracket having a fixed rail for receiving an intermediate rail, an intermediate rail slidably engaging said mounting bracket fixed rail, an outer pull out guide for attachment to the drawer, slidably engaging said intermediate rail relative to said intermediate rail and said fixed rail, and having a protrusion on the bottom surface of the outer pull out guide, a damping device and a channel guide disposed along the mounting bracket adjacent its fixed rail, said damping device being resiliently compressible in a lengthwise direction and said channel guide having a sliding member;

the sliding member including an inner portion that travels along the guide and an outer portion that extends upwardly from the guide so as to be contactable by said pull out guide protrusion and locates an end of the damping device that can be pushed inwardly to provide damping, said mounting bracket having a stopper defining a rear travel limit of the pull out guide, said stopper located such that it is forward relative to a rear travel limit position of the sliding member within the channel guide;

whereby, during a closing action of the assembly, the outer pull out guide is caused to slide in a drawer-closing direction and when said protrusion reaches and contacts the sliding member outer portion, the sliding member travels within said channel guide against the resilience of said damping device and causes deceleration of the drawer-closing motion; and whereby, during a closing action of the assembly, the stopper engages and stops the pull out guide before the sliding member reaches the rear travel limit within the channel guide.

9. A guide rail assembly as claimed in claim 8, wherein said damping device comprises a cylinder body and a rod that is pushable into the cylinder body when the device is compressed, the distal end of the rod being located in the sliding member outer portion.

10. A guide rail assembly as claimed in claim 8, wherein said damping device is a fluid damper.

11. A guide rail assembly as claimed in claim 8, wherein said channel guide has an open top and open longitudinal ends such that the sliding member outer portion extends upwardly through the open top of the channel guide and locates an end of the damping device through an open longitudinal end of the channel.

12. A guide rail assembly as claimed in claim 8, wherein said sliding member outer portion further comprises an aperture for receiving said end of the damping device.

13. A guide rail assembly as claimed in claim 8, wherein said stopper is a tab that is integral with said mounting bracket.

14. A guide rail assembly as claimed in claim 8, wherein said outer pull out guide protrusion further comprises a protruding surface and an abutment surface, said protruding and abutment surfaces engagable with the outer portion of said sliding member and said mounting bracket stopper respectively.

15. A guide rail assembly as claimed in claim 8, wherein said intermediate rail comprises a C-shaped guide that is slidable along the mounting bracket fixed rail and a channel piece disposed on top of said C-shaped guide, whereby said outer pull out guide is slidable along said channel piece of said intermediate rail.

16. A guide rail assembly as claimed in claim 8, wherein said outer pull out guide protrusion is disposed toward a front end of the pull out guide.

17. A guide rail assembly as claimed in claim 8, wherein said outer pull out guide protrusion is removable from the pull out guide.

18. A guide rail assembly as claimed in claim 8, wherein the fixed rail and outer pull out guide each further comprises a slidable housing having a plurality of rollers that enables the intermediate rail to be slidable on the fixed rail and the outer pull out guide to be in turn slidable on the intermediate rail.

* * * * *